US006328426B1

(12) United States Patent
Chahn et al.

(10) Patent No.: US 6,328,426 B1
(45) Date of Patent: Dec. 11, 2001

(54) PRINTER DEVICE

(75) Inventors: Lee Chahn, Hitachinaka; Hideki Shinohara, Tsukuba; Shigetaka Fujiwara, Hitachi; Shuji Imazeki, Hitachi; Seiji Yonekura, Hitachi; Yoshiharu Nagae, Chiba, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/427,627

(22) Filed: Oct. 27, 1999

(30) Foreign Application Priority Data

Oct. 27, 1998 (JP) ..... 10-305350

(51) Int. Cl.[7] ..... B41J 2/06; B41J 2/095
(52) U.S. Cl. ..... 347/55
(58) Field of Search ..... 347/55, 112

(56) References Cited

FOREIGN PATENT DOCUMENTS

| | | | |
|---|---|---|---|
| 0 703 080 A2 | | 3/1996 | (EP) . |
| 0 761 441 A2 | | 3/1997 | (EP) . |
| 0 869 004 A2 | | 10/1998 | (EP) . |
| 54-51837 | * | 4/1979 | (JP) . |
| 56-4467 | * | 1/1981 | (JP) . |
| 08-174815 | * | 7/1996 | (JP) . |
| WO 93/11866 | | 6/1993 | (WO) . |

* cited by examiner

*Primary Examiner*—Huan Tran
(74) *Attorney, Agent, or Firm*—Antonelli, Terry, Stout & Kraus, LLP

(57) ABSTRACT

A printer device includes a plurality of discharge electrodes provided in a slit to which ink containing charged pigment particles is supplied, a plurality of opposing electrodes opposing the plurality of discharge electrodes, a pulse electric field applicator for forming a pulse electric field between the plurality of discharge electrodes and the plurality of opposing electrodes, and auxiliary electrodes. The auxiliary electrodes are provided at both sides of respective ones of the plurality of discharge electrodes, and a high or low potential is applied to the auxiliary electrodes so as to cancel out an electric interaction between respective ones of the plurality of discharge electrodes.

8 Claims, 22 Drawing Sheets

PRINTER DEVICE

BACKGROUND OF THE INVENTION

1. Field of the Invention

The present invention relates to a printer device which causes to fly or travel ink containing charged pigment particles through an electric field.

2. Conventional Art

The following ink discharge methods for an ink jet recording device which forms pixels on a recording medium by blowing liquid ink drops were known:

(1) an electro and thermal conversion method in which ink is discharged from a nozzle by making use of pressure of bubbles caused by heating the ink through a heating element.

(2) an electro static method in which insulative ink solvent is polarized by an electric field or conductive ink solvent is electro-statically pulled out. JP-B-56-9429 discloses an ink jet recording device using the electro and thermal conversion method, and JP-A-56-4467 and JP-A-8-174815 disclose ink jet recording devices using the electro static method.

However, the ink jet recording device as mentioned above using the electro and thermal conversion method is not suitable for a gradation recording, because the ink discharge amount does not depend on the applied voltage. Further, although it is necessary to provide respective heating elements for respective nozzles, it is difficult to arrange the nozzles in high density. Moreover, if the diameter of the nozzle aperture is reduced in order to improve resolution, the nozzle aperture tends to clog due to solidification of the ink which reduces discharge stability of the ink.

On the other hand, in the ink jet recording device as mentioned above using the electro static method, since the ink discharge amount sensitively responds to a variation of electric field near the top of the respective nozzles, the ink discharge amount tends to unstabilize. Further, when a conductive ink is used, it is necessary to avoid a mutual action between flying liquid ink drops by limiting discharge frequency of the ink from the nozzles which reduces recording speed.

SUMMARY OF THE INVENTION

Accordingly, an object of the present invention is to provide a printer device which shows an excellent discharge stability of ink and further permits a highly accurate and high gradation recording with a high speed.

A printer device according to the present invention which achieves the above object and in which a plurality of discharge electrodes are provided in a slit to which ink containing charged pigment particles is supplied, an electric field is formed between the plurality of discharge electrodes and an opposing electrode opposing to the plurality of discharge electrodes, and liquid ink drops are caused to fly from top ends of the plurality of discharge electrodes toward the opposing electrode, is characterized in that the charged pigment particles contained in the ink are caused to aggregate at the top end portions of the respective discharge electrodes and liquid ink drops, each containing more than 50 vol % of the aggregates of the charged pigment particles, are caused to fly.

Further, the printer device according to the present invention can cause to aggregate the charged pigment particles contained in the ink and cause to fly the liquid ink drops each containing the aggregates of the charged pigment particles, if at least one of the following four conditions is satisfied:

(1) diameter of a print dot is about 1 $\mu$m~10 $\mu$m;

(2) a pulse electric field applying means is provided between the respective discharge electrodes and the opposing electrode and the pulse electric field applying means further includes a control means which varies the diameter of the print dot by varying a pulse voltage and pulse width;

(3) partition members for guiding ink stream are provided at both sides of the respective discharge electrodes, and the top ends of the partition members (the top ends from which the liquid ink drops flow out) are restricted; and (4) the top ends of the respective discharge electrodes are restricted in a triangle shape in order to concentrate electric field at the top ends of the respective discharge electrodes, the restricted top end angle is selected less than 90°, and preferably to be 30°~70°.

The ink used preferably satisfies at least one of the following two conditions:

(1) charged amount per unit mass of the charged pigment particles is 10~200 mC/g and, the charged pigment having particle radius of 0.1~5 $\mu$m is contained in 2~10 vol %; and (2) at least two kinds of charged pigment particles having different charged amount per unit mass and different particle diameter are included.

According to the present invention, a printer device can be realized which shows a high ink discharge stability and permits a highly accurate, fine and high gradation recording with a high speed.

BRIEF DESCRIPTION OF THE DRAWINGS

FIG. 6(*b*) is an arrangement diagram of the discharge electrode in the recording head relating to the one embodiment according to the present invention;

FIG. 7(*b*) is a diagram of voltage wave form applied to the opposing electrode relating to the one embodiment according to the present invention;

DESCRIPTION OF THE PREFERRED EMBODIMENT

Hereinbelow, one embodiment according to the present invention will be explained with reference to the drawings attached.

Figure 8:
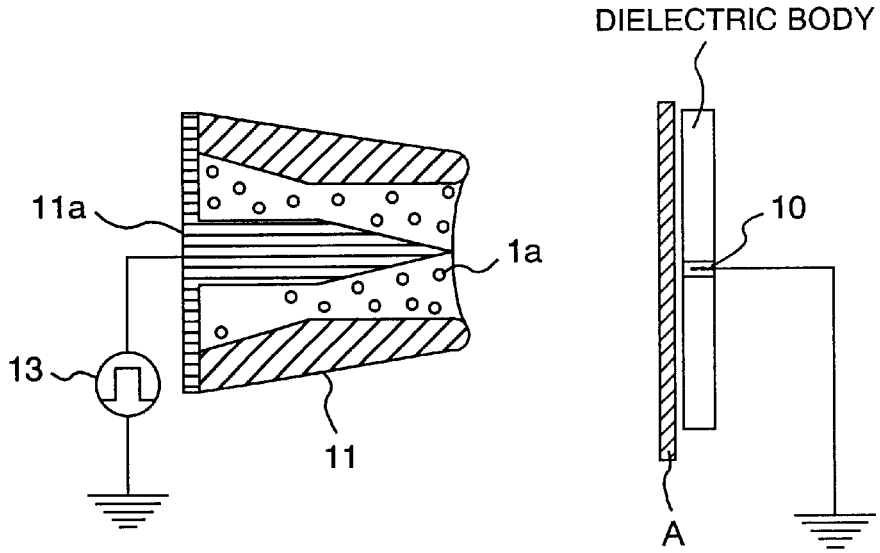
FIG. 8 is a model diagram of a simplified recording head.

At first, flying principle of ink according to the present embodiment will be explained. However, herein for the sake of explanation convenience a simplified model (see FIG. 8) is used for the explanation in which a single discharge electrode 11*a* is disposed in an orifice storing ink containing charged pigment particles.

Figure 24:
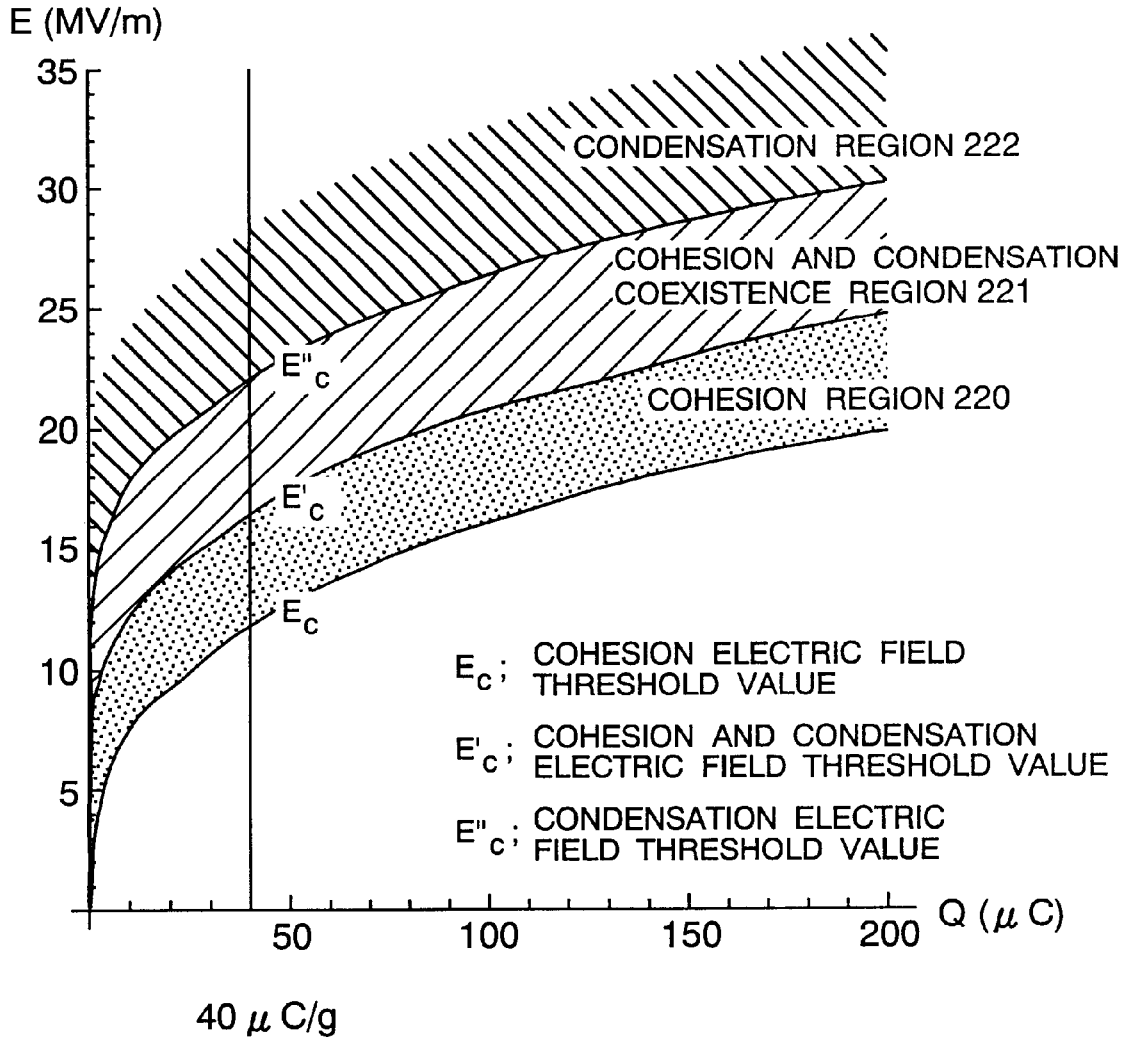
FIG. 24 is a diagram in which electric field at the top end of the discharge electrode is classified according to flying modes of a pigment aggregate.

Primarily, with regard to electric field regions which permit to fly out liquid ink props from the top end of the discharge electrode in a printer device, there exist three regions showing different flying modes of the liquid ink drops as illustrated in FIG. 24 details of which will be explained below.

Figure 9:
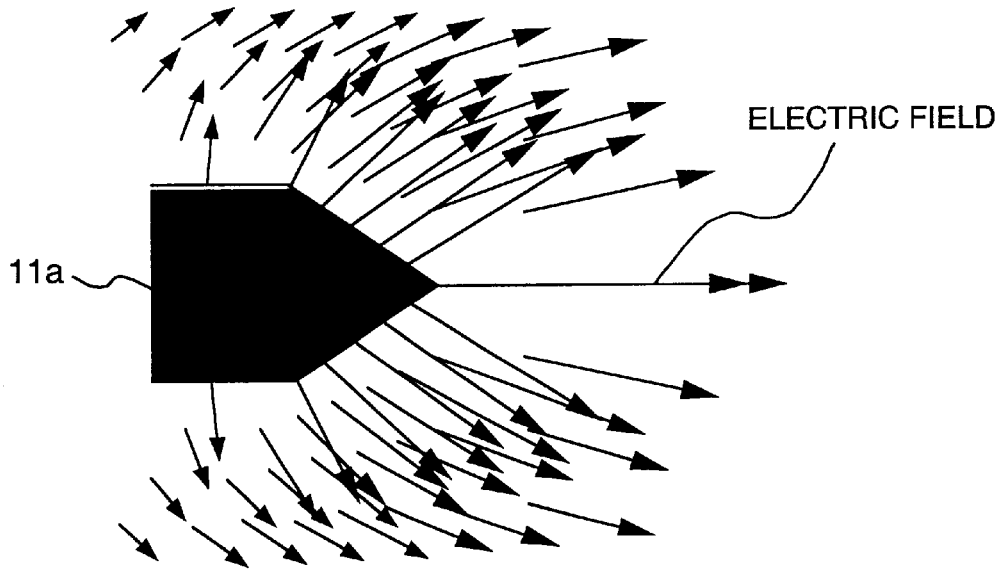
FIG. 9 is a two dimensional electric field analysis diagram near the top end of the discharge electrode shown in FIG. 8.

When a pulse voltage from a pulse voltage generating device 13 is applied to the discharge electrode 11*a,* an electric field directed from the side of the discharge electrode 11*a* toward an opposing electrode 10 is generated as illustrated in FIG. 9.

Figure 10:
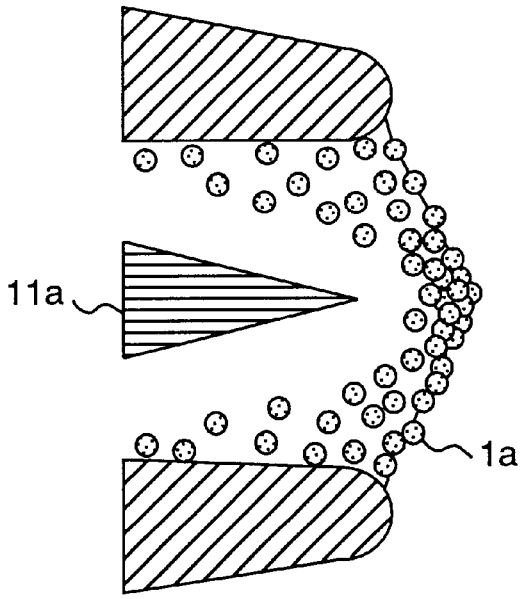
FIG. 10 is an enlarged view near the top end of the discharge electrode shown in FIG. 8.
Figure 11:
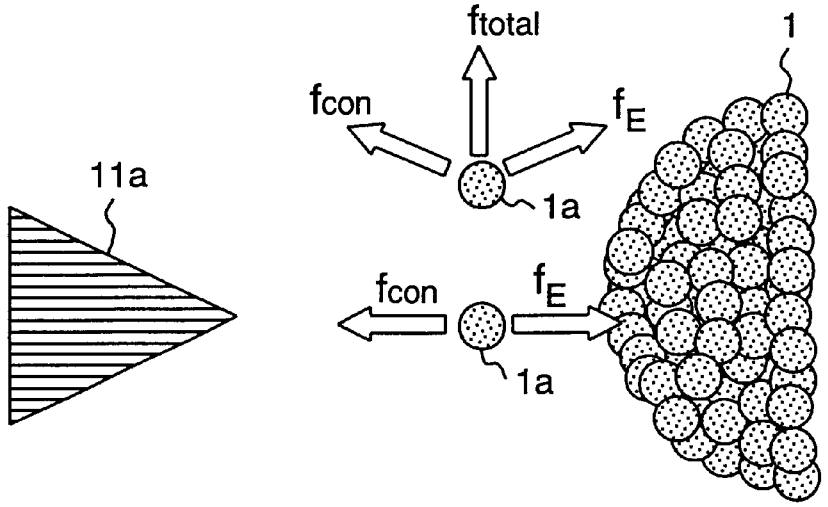
FIG. 11 is a view for explaining forces acting on spherical shaped charged pigment particles grown near the liquid ink surface.

Herein, since the discharge electrode 11*a* having a sharp top end is used, the most intense electric field is generated near the top end. When such electric field is generated, individual charged pigment particles 1*a* in the ink solvent respectively move toward the liquid ink surface by force fE acted by the electric field as illustrated in FIG. 10. Thereby, the pigment particle density near the liquid ink surface is condensed. Then a plurality of charged pigment particles 1*a* near the liquid ink surface are gathered toward the opposite side of the electrode to begin aggregation as illustrated in FIG. 11. When a pigment aggregate 1 begins to grow in to a spherical shape near the liquid ink surface, an electrostatic repulsion force fcon from the pigment aggregate 1 begins to act on the individual charged pigment particles 1*a.* Namely, on each of the individual charged pigment particles la a resultant force ftotal of the electrostatic repulsion force fcon from the pigment aggregate 1 and a force fE from the electric field E due to the pulse voltage is acted. Accordingly, within a range where the electrostatic repulsion force between the charged pigment particles does not exceed mutual aggregation force, when the force fE caused by the electric field on a charged pigment particle 1*a* (a charged pigment particle 1*a* on a straight line connecting between the top end of the discharge electrode 11*a* and the center of the pigment aggregate 1) on which the resultant force ftotal toward the pigment aggregate 1 is acted exceeds the electrostatic repulsion force fcon from the pigment aggregate 1 (fE≧fcon), the pigment particles 1*a* grow into the pigment aggregate 1. Based on the above fact radius Rcon of a spherical shaped pigment aggregate 1 formed near the liquid ink surface can be calculated as follows.

When assuming that the shape of the pigment aggregate 1 is a perfect sphere, a relationship between the volume of the spherical shaped pigment aggregate 1 formed by n pieces of charged pigment particles 1*a* and the volume of one piece of the charged pigment particle 1*a* is expressed by the following formula (1);

$$\alpha = \frac{4\pi}{3}R^3 = n\frac{4\pi}{3}r^3 \tag{1}$$

Wherein, α is a ratio (filling rate) of the volume of n pieces of charged pigment particles 1*a* with respect to the volume of the pigment aggregate 1 (the same definition is applied to all of the formulas hereinbelow). A filling rate when things having any configurations are filled into a predetermined volume is generally 50%~90%, therefore, the filling rate of a liquid ink drop which flies from the discharge electrode according to the ink flying principle of the present embodiment is also 50%~90%. For example, in case of a face-centered cubic crystal structure (FCC) the filling rate α is 70%.

Further, an electric field induced by the electric charge of the pigment aggregate 1 formed by n pieces of charged pigment particles 1*a* at the position having distance S from the center of the pigment aggregate 1 is expressed by the following formula (2);

$$E_{con} = \frac{1}{4\pi\varepsilon}\frac{nq}{S^2} \tag{2}$$

Wherein, π is circle ratio, ∈ is dielectric constant of the ink solvent and q is electric charge amount per one piece of the charged pigment particle 1*a* as expressed by the following formula (3) (the above definitions are likely applied to all of the formulas hereinbelow);

$$q = \frac{Q\rho}{\frac{1}{\frac{4}{3}\pi r^3}} = \frac{4}{3}\pi Q\rho r^3(\mu C) \tag{3}$$

Wherein, Q is electric charge amount per unit mass of the charged pigment particle 1*a,* ρ is density of the charged pigment particle 1*a* and r is radius of the charged pigment particle 1*a* (the above definitions are likely applied to all of the formulas hereinbelow).

Now, in order to grow the pigment aggregate 1 when a charged pigment particle 1*a* touches to the pigment aggregate 1, the force fE acted on the charged pigment particle 1*a* due to the electric field E caused by the pulse voltage has to exceed the electrostatic repulsion force fcon acting between the pigment aggregate 1 and the charged pigment particle 1*a*. Namely, the condition under which the pigment aggregate 1 starts growing when a charged pigment particle 1*a* touches to the pigment aggregate 1 is to satisfy the following formula (4);

$$f\text{con}-f_E-=qE\text{con}-qE=q(E\text{con}-E)=0 \tag{4}$$

Now, when assuming that the distance S between the charged pigment particle 1*a* and the pigment aggregate 1 under their touching condition is equal to the radius Rcon of the pigment aggregate 1, then the following formula (5) representing the radius Rcon of the pigment aggregate 1 can be arrived based on the mathematical formulas (1), (2), (3) and (4);

$$R_{con} = 4\pi\varepsilon\frac{3}{4\pi}\frac{E}{Q\rho\alpha} \tag{5}$$

Figure 12:
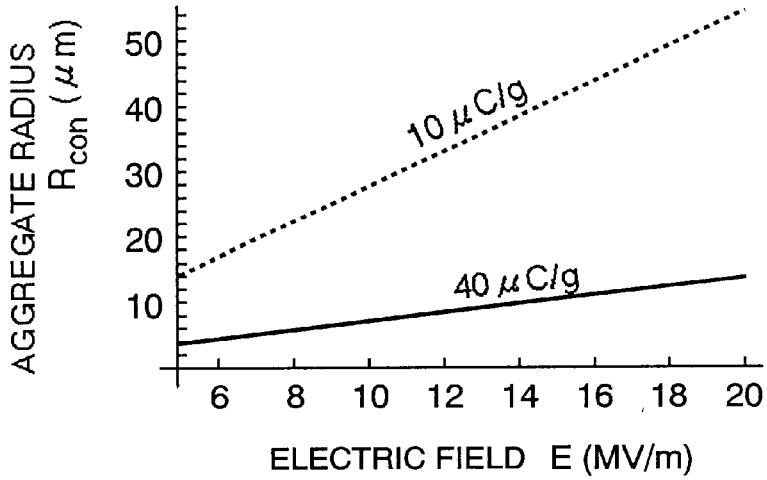
FIG. 12 is a graph showing a relationship between electric field at the top end of the discharge electrode shown in FIG. 8 and radius of a spherical shaped pigment aggregate.

In view of the mathematical formula (5), it will be understood that the radius Rcon of the pigment aggregate 1 formed near the liquid ink surface is proportional to the electric field E induced by the pulse voltage. For example, when substituting the following typical data for the parameters ∈, Q, ρ and α in the mathematical formula (3) and the resultant relationship between Rcon and E is graphically illustrated (in FIG. 12), the above referred to proportional relationship can be visually recognized.

Q:10(μC/g) and 40(μC/g)

ρ:1.4(g/cm$^3$)

α:0.7

$1/(4\cdot\pi\cdot\in)$:8.98774×10$^9$($C^{-2}\cdot N\cdot m^2$)

Figure 13:
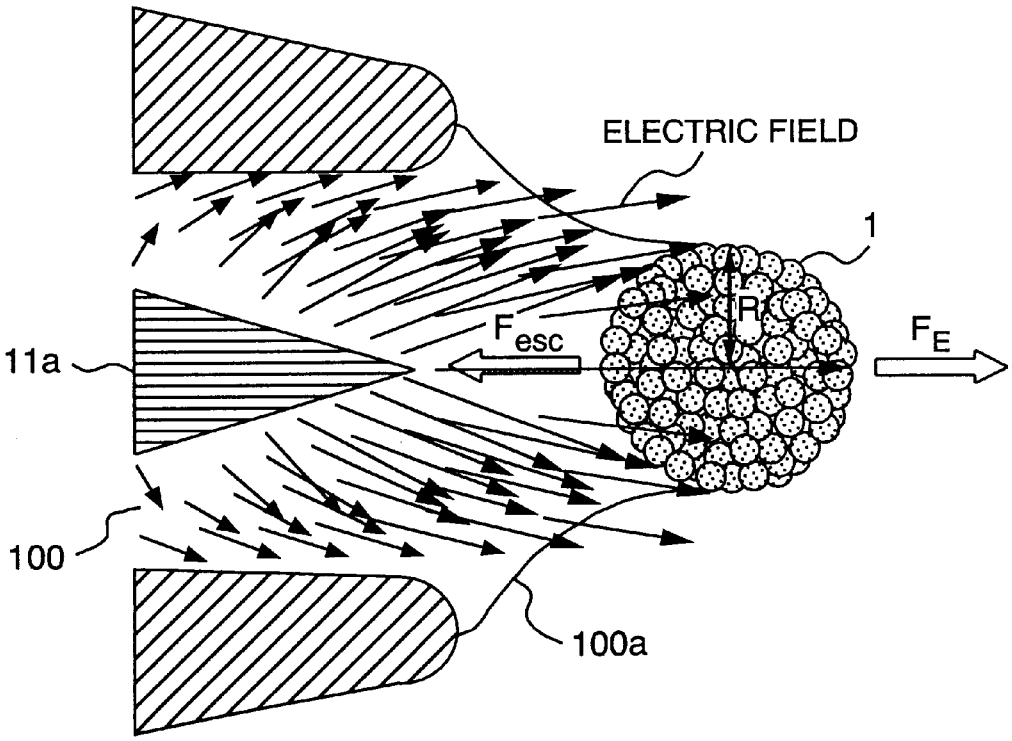
FIG. 13 is another enlarged view near the top end of the discharge electrode as shown in FIG. 8.

Now, the pigment aggregate 1 formed from the n pieces of charged pigment particles 1*a* is on one hand acted by an electrostatic repulsion force FE due to the electric field E caused by the pulse voltage, and on the other hand, acted by a binding force Fesc from the ink solvent as illustrated in FIG. 13. The electrostatic repulsion force FE is represented by the following mathematical formula (7) and is expressed by a cubic function of the radius R of the pigment aggregate 1, and the binding force Fesc of the ink solvent is represented by the following mathematical formula (6) and is expressed by a liner function of the radius R of the pigment aggregate 1, and the both functional relations are graphically illustrated in FIG. 14;

$$\text{Fesc}=2\pi\text{Rv} \tag{6}$$

$$F_E=nqE=4/3\cdot\pi Q\cdot\rho\cdot E\cdot\alpha\cdot R^3 \tag{7}$$

Wherein, E is an electric field caused at the center of the pigment aggregate 1 due to the pulse voltage, and v is surface tension of the ink solvent (the above definitions are applied to all of the mathematical formulas hereinbelow).

Figure 14:
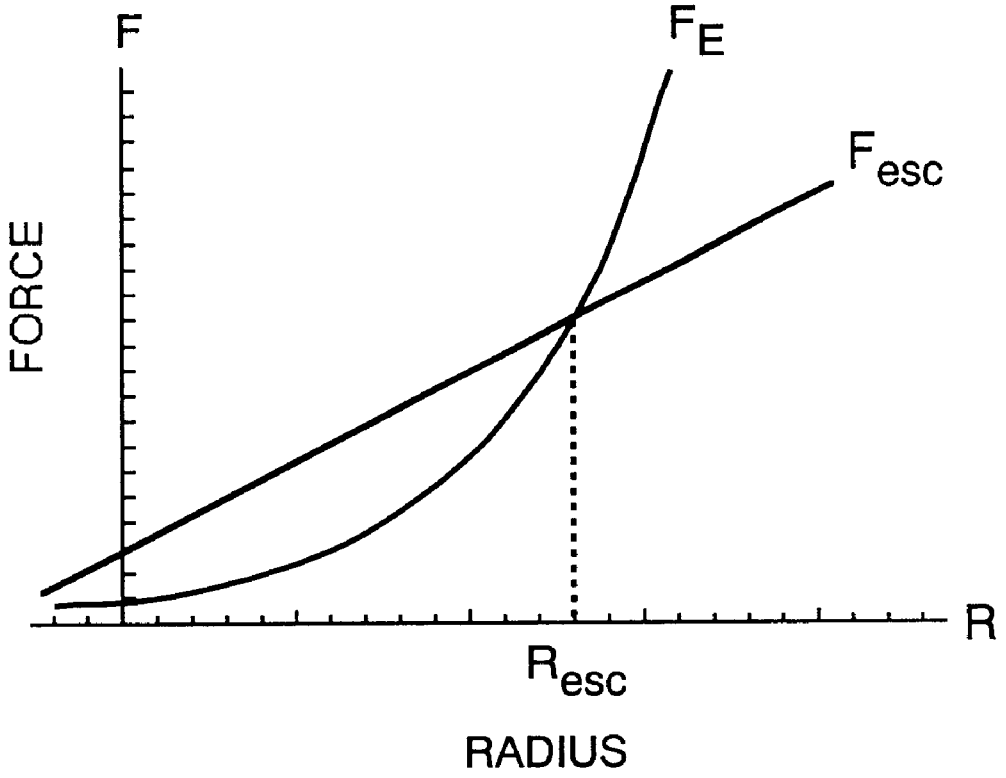
FIG. 14 is a graph showing a relationship between forces applied to a spherical shaped pigment aggregate and radius thereof.

When the electrostatic repulsion force FE and the bonding force Fesc balance, the pigment aggregate 1 stabilizes under a condition that the pigment aggregate 1 somewhat projects from the liquid ink surface 100*a*. The radius of the pigment aggregate 1 at this moment is Resc as illustrated in FIG. 14, and the following mathematical formula (8) representing Resc is arrived based on the mathematical formulas (6) and (7);

$$Resc = \sqrt{\frac{3v}{2\alpha Q\rho E}} \tag{8}$$

Figure 15:
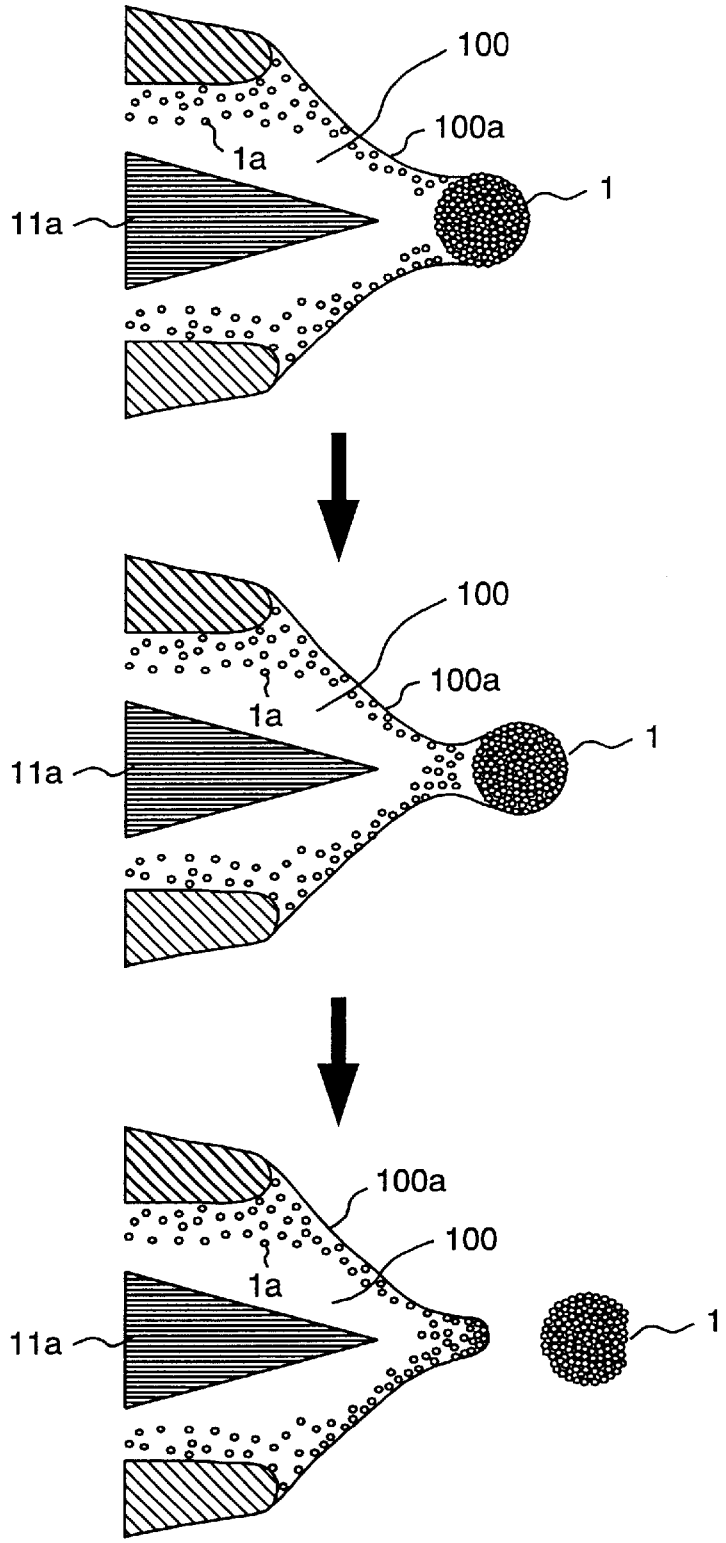
FIG. 15 a diagram showing flying process of a spherical shaped aggregate.
Figure 16:
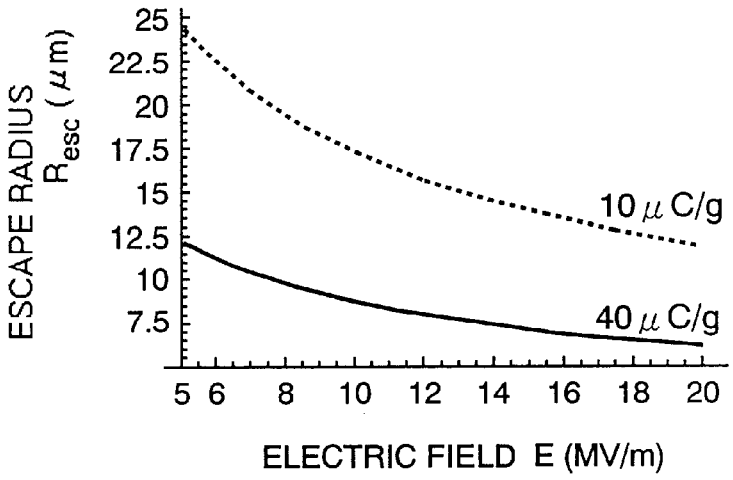
FIG. 16 is a graph showing a relationship between electric field at the top end of the discharge electrode as showing in FIG. 8 and escape radius of the spherical shaped pigment aggregate.

When the pigment aggregate 1 further grows and the electrostatic repulsion force FE exceeds the bonding force Fesc, the pigment aggregate 1 escapes from the liquid ink surface 100*a* as illustrated in FIG. 15. Namely, when the radius of the pigment aggregate 1 grows more than the radius Resc (hereinbelow called as escape radius Resc) as represented by the mathematical formula (8), the pigment aggregate 1 flies out from the ink solvent 100. In view of the mathematical formula (8), it will be understood that the escape radius Resc of the pigment aggregate 1 is in inverse proportional to $\sqrt{E}$, square root of the electric field E induced by the pulse voltage. For example, when substituting the following typical data for the parameters v, α, Q and ρ in the mathematical formula (8) and the resultant relationship between Resc and E is graphically illustrated in FIG. 16, the above inverse proportional relationship can be visually recognized.

v:20 dyn/cm

α:0.7

Q:10(μC/g) and 40(μC/g)

ρ:1.4(g/cm$^3$)

Figure 17:
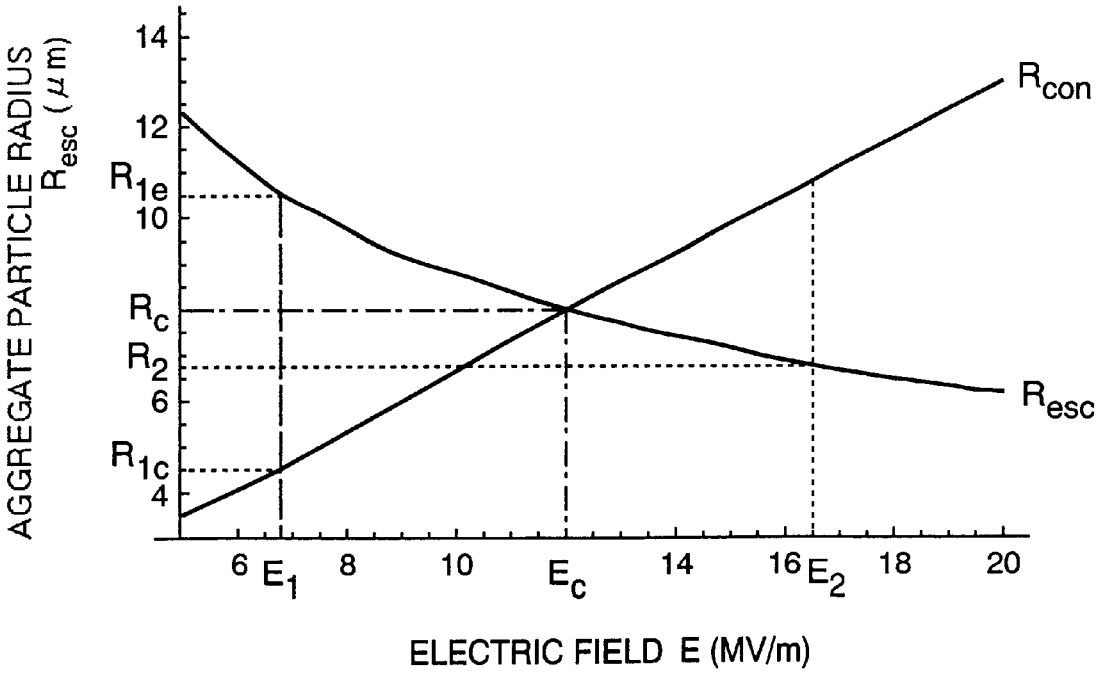
FIG. 17 a graph for explaining a first threshold value electric field serving as flying start point of a spherical shaped aggregate.

As the result of the above observation, it will be understood that in order to fly out the pigment aggregate 1 from the top end of the discharge electrode 11*a,* it is necessary to apply an electric field near the top end of the discharge electrode 11*a* which exceeds a predetermined intensity. Namely, as illustrated in FIG. 17 in which characteristics shown in FIGS. 12 and 16 with regard to the charged pigment particle 1*a* having electric charge amount of 40 μC/g per unit mass are collected, it will be understood that when at least an electric field Ec (hereinbelow called as first threshold value electric field Ec) is applied near the top end of the discharge electrode 11*a,* the radius Rcon of the pigment aggregate 1 exceeds the escape radius Resc and the pigment aggregate 1 begins to fly out from the top end of the discharge electrode 11*a*. The first threshold value electric field Ec can be arrived according to the following mathematical formula (9) by assuming that Rcon=Resc in the mathematical formulas (5) and (8);

$$Ec = \left(\frac{1}{4\pi\varepsilon}\frac{4}{3}\pi\right)^{\frac{2}{3}}\left(\frac{3}{2}vQ\rho\alpha\right)^{\frac{1}{3}} \tag{9}$$

Figure 18:
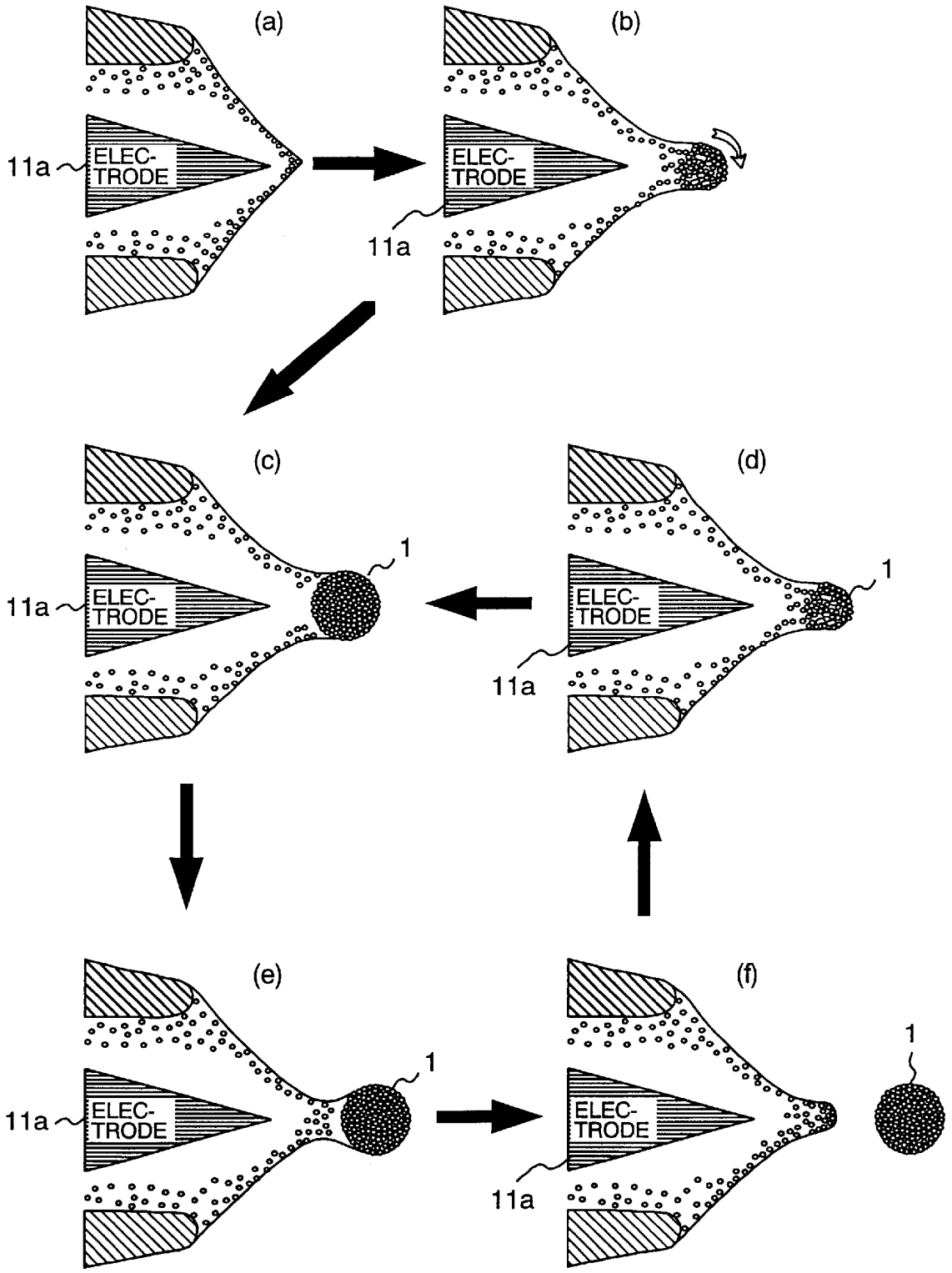
FIG. 18 is a diagram showing a periodical flying process of a spherical shaped pigment aggregate.

Thereafter, if the application of the first threshold value electric field Ec at the top end of the discharge electrode 11*a* is continued, pigment aggregates 1 repeatedly fly out in a proper cycle of (c)~(f) from the top end of the discharge electrode 11*a* as illustrated in FIG. 18. The phenomenon as illustrated in FIG. 18 is caused in a lower portion of a cohesion region (220 in FIG. 24) which will be explained later.

Figure 19:
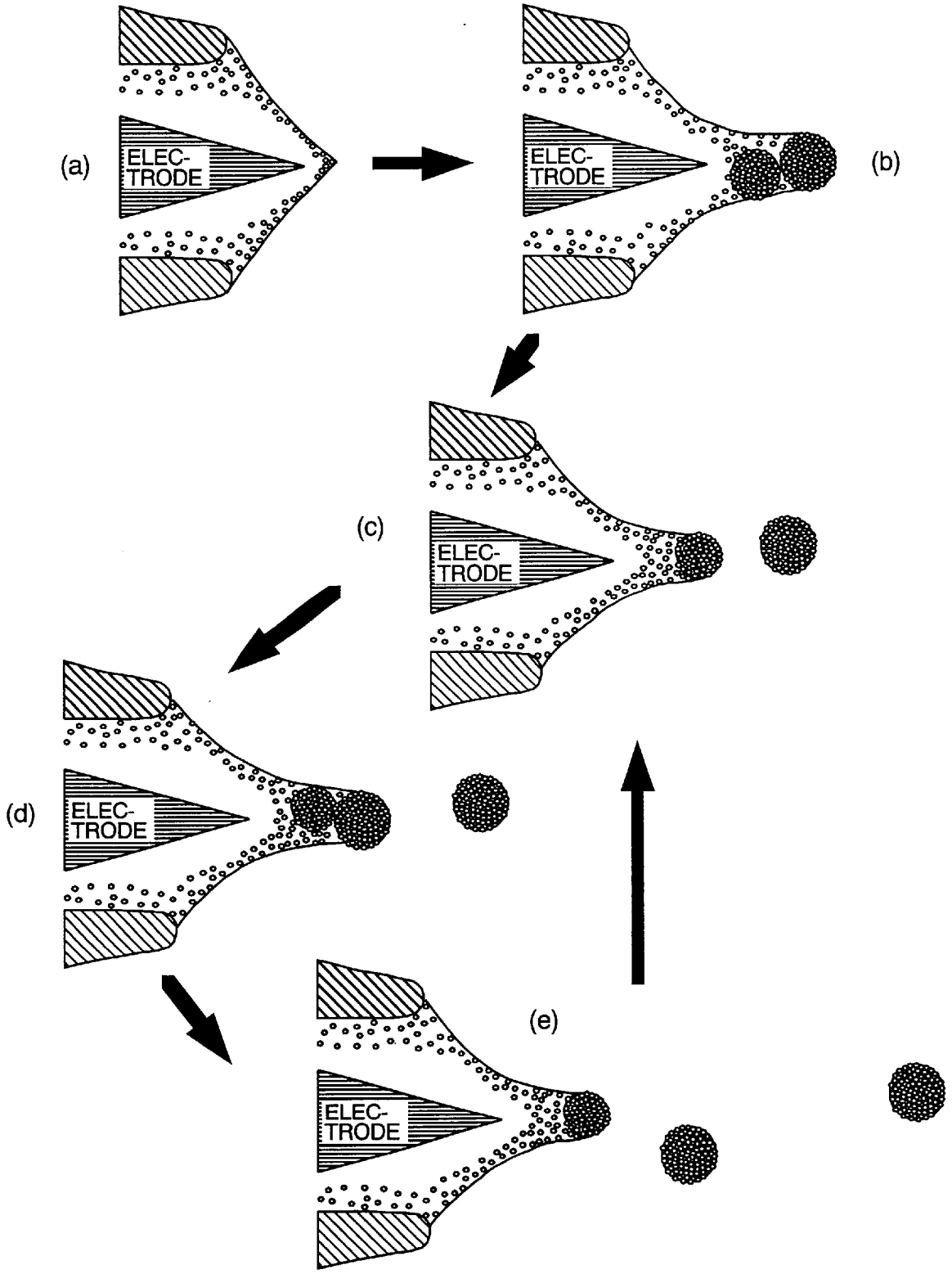
FIG. 19 is a diagram showing another periodical flying process of a spherical shaped pigment aggregate.

When the intensity of the electric field at the top end of the discharge electrode 11*a* is further increased, the aggregation force and the aggregation speed of the charged pigment particles 1*a* are enhanced as well as the escape radius Resc of the pigment aggregate 1 is reduced, therefore, pigment aggregates with further smaller diameter repeatedly fly out in further shorter cycle of (c)~(e) as illustrated in FIG. 19. The phenomenon as shown in FIG. 19 is caused in an upper portion of a cohesion region (220 in FIG. 24) which will be also explained later.

Figure 20:
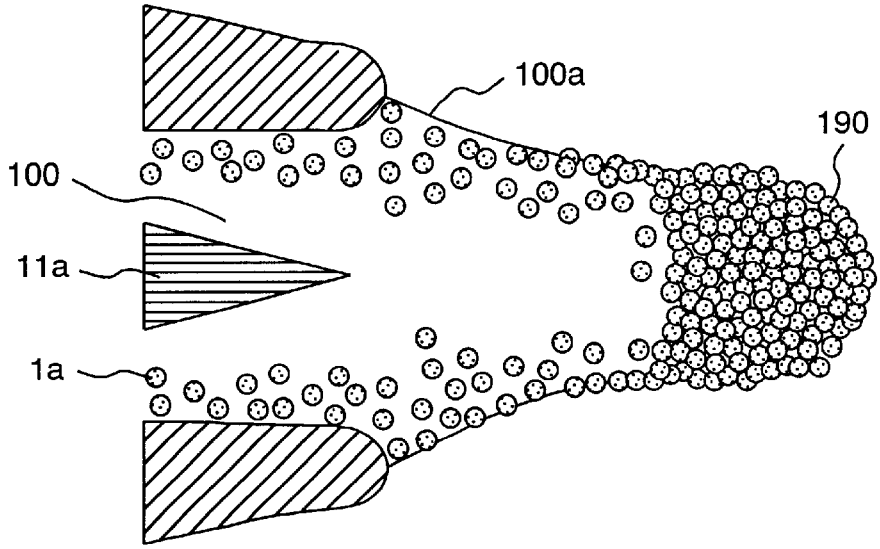
FIG. 20 is still another enlarged view near the top end of the discharge electrode as shown in FIG. 8.
Figure 21:
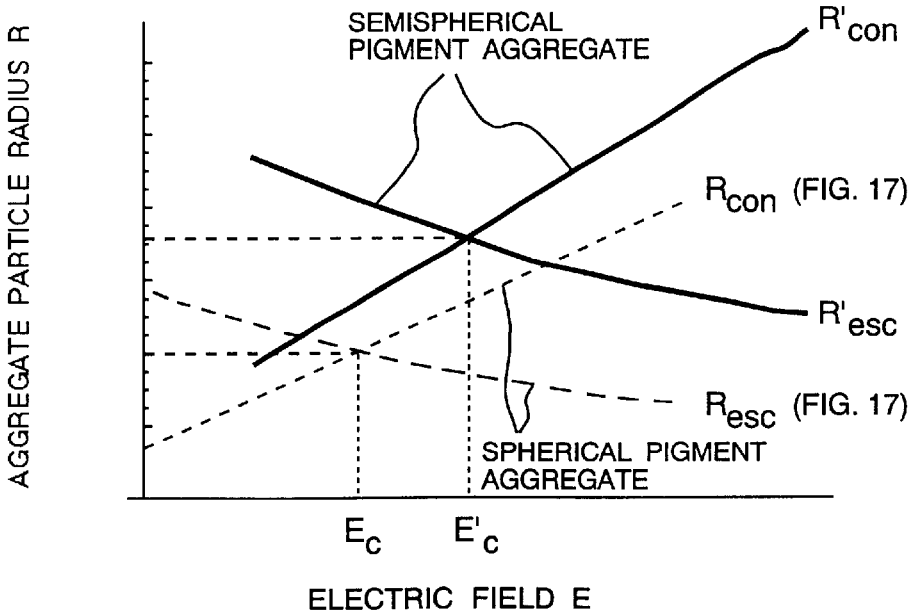
FIG. 21 is a graph for explaining a second threshold value electric field serving as flying start point of a semispherical shaped pigment aggregate.

Further, when the electric field at the top end of the discharge electrode 11*a* exceeds about 1.5 times of the first threshold value electric field Ec, the aggregation force and the aggregation speed of the charged pigment particles 1*a* substantially increase, semispherical shaped or thick shell shaped pigment aggregates 190 tailing toward the discharge electrode 11*a* as illustrated in FIG. 20 begin to grow together with the spherical shaped pigment aggregates 1 as illustrated in FIG. 11. When assuming the shape of the pigment aggregate 190 as a semispherical shape, a minimum electric field (hereinbelow called as a second threshold electric field E'c) which causes to fly such semispherical shaped or thick shell shaped pigment aggregates 190 from the top end of the discharge electrode 11*a* can be derived according to the similar calculation sequence used for obtaining the first threshold value electric field Ec. For example, when two mathematical formulas relating to the radius R'con and the escape radius R'esc of the pigment aggregate 190 with regard to electric field are derived by making use of the same parameter values (v:20 dyn/cm, α:0.7, Q:40 μC/g, ρ: 1.4 g/cm$^3$) as used for preparing the graph shown in FIG. 17, the second threshold value electric field E'c can be determined from the crossing point of two curves representing the derived two mathematical formulas as illustrated in FIG. 21. Further, the reason, why the two curves representing the radius R'con and the escape radius R'esc of the semispherical shaped pigment aggregate 190 is shifted toward upper right side with regard to the two curves (also illustrated in FIG. 17) representing the radius Rcon and the escape radius Resc of the spherical shaped pigment aggregate 1 as illustrated in FIG. 21, is that the volume of the semispherical shaped pigment aggregate 190 is only ½ of the volume of the spherical shaped pigment aggregate 1 having the same diameter as the semispherical shaped pigment aggregate 190.

Figure 23:
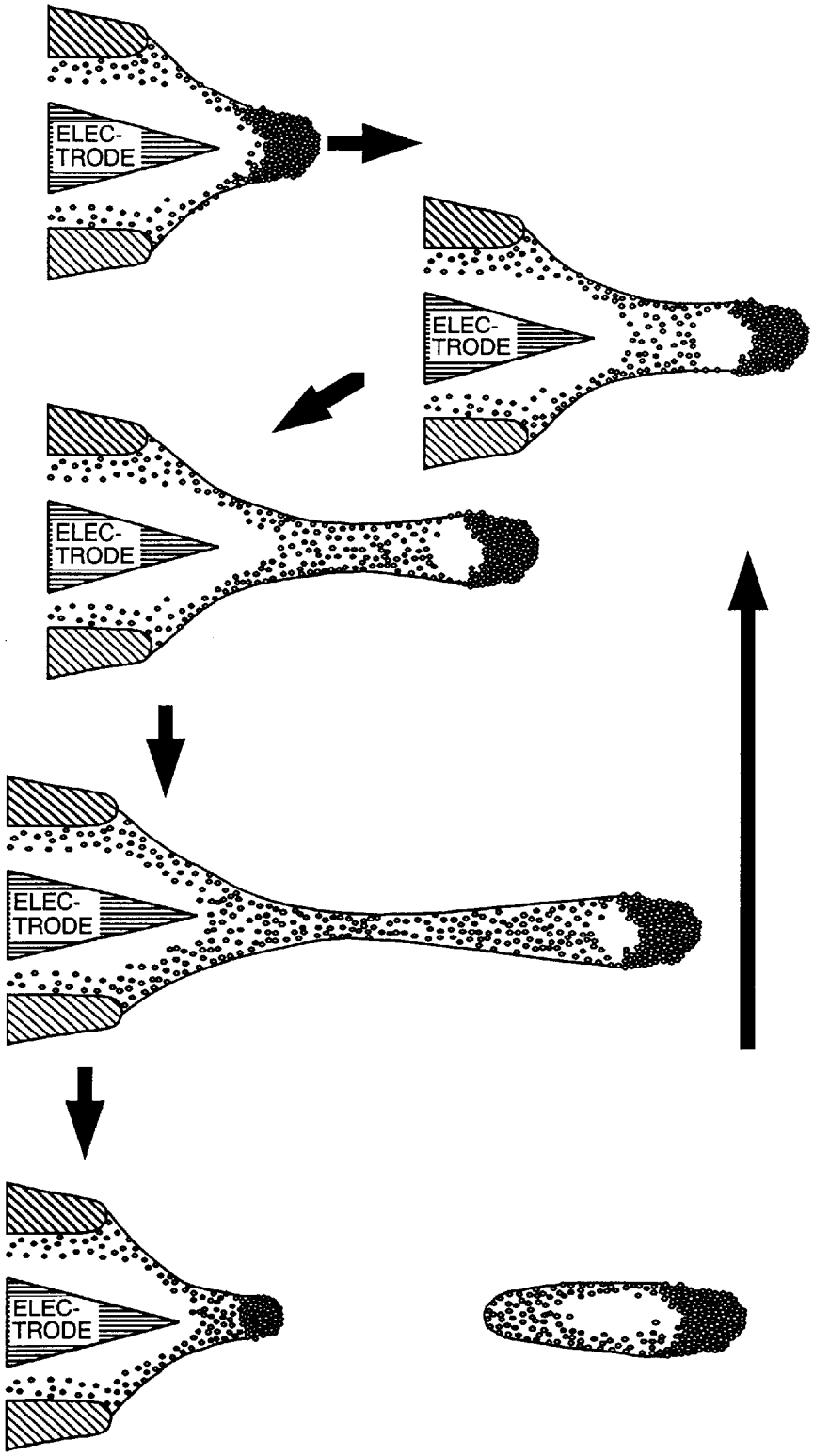
FIG. 23 is a diagram showing a periodical flying process of a semispherical shaped aggregate.

Further, when the intensity of the electric field at the top end of the discharge electrode 11*a* is further intensified over the second threshold value electric field E'c, only the semispherical shaped or thick shell shaped pigment aggregates 190 repeatedly grow and fly out in a short cycle as illustrated in FIG. 23. Further, the phenomenon as illustrated in FIG. 23 is induced in a lower portion of a cohesion and condensation coexistence region (221 in FIG. 24) which will also be explained later.

Figure 22:
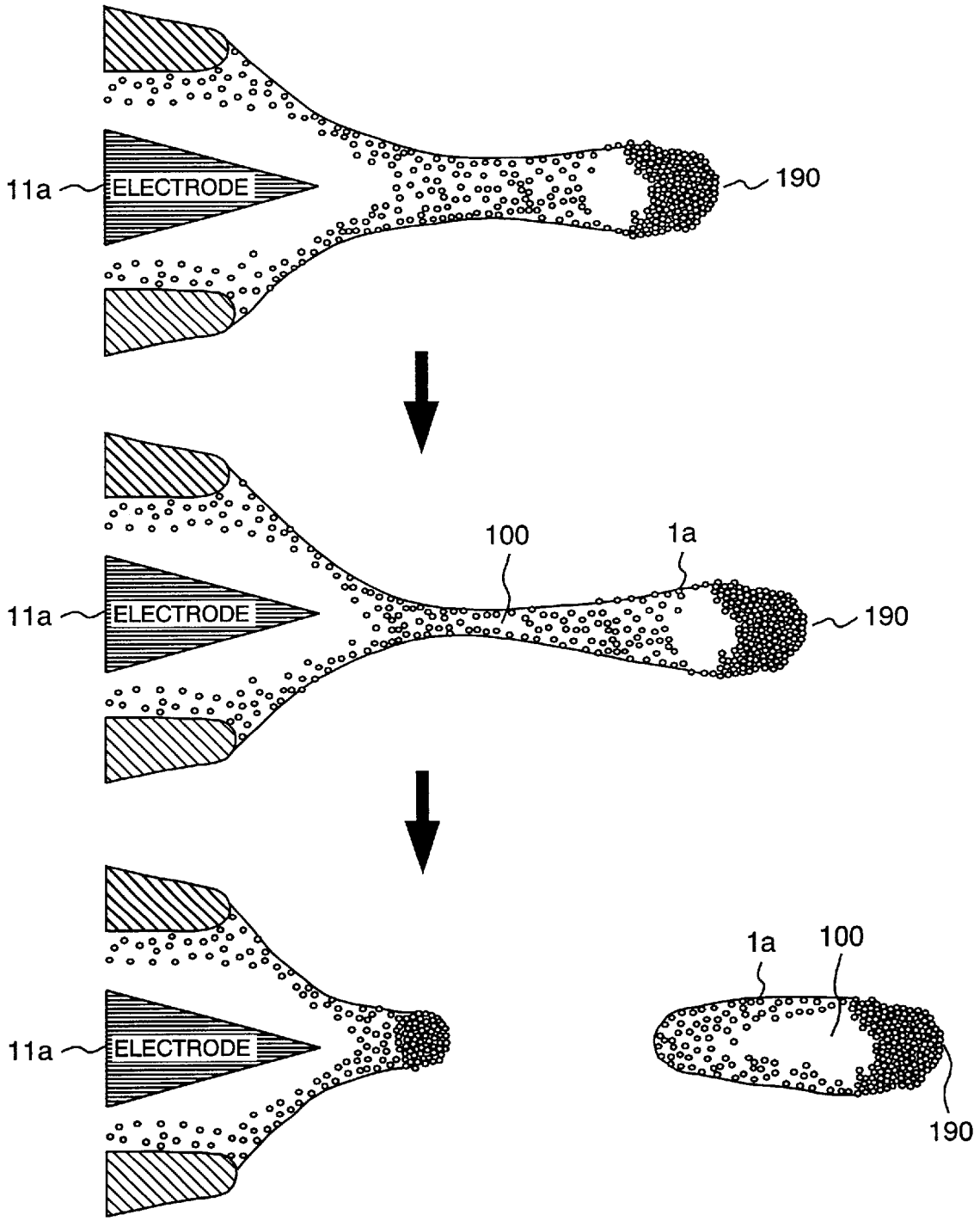
FIG. 22 is a diagram showing a flying process of a semispherical shaped pigment aggregate.

Now, when the semispherical shaped or thick shell shaped pigment aggregates 190 as illustrated in FIG. 20 fly, the pigment aggregate 190 drags the ink solvent 100 at the back side thereof as illustrated in FIG. 22, therefore, the ink solvent 100 condensed near the liquid ink surface also flies while following in a string shape at the back side of the pigment aggregate 190. Further, the phenomenon as illustrated in FIG. 22 is induced in an upper portion in a cohesion and condensation coexistence region (221 in FIG. 24) which will also be explained later.

The spherical shaped pigment aggregate 1 as shown in FIG. 11 hardly involves the ink solvent, because the back side thereof also a spherical shape and the above referred to tailing phenomenon never happens. Accordingly, if an electric field more than the second threshold value electric field E'c is applied at the top end of the discharge electrode 11*a*, a further larger pixel can be recorded on a recording medium. Further, since the ink solvent 100 likely deposits on the recording medium and because of its surface tension the pigments are prevented from being covered by dust, thereby, a further accurate recording can be performed. Further, the reasons why the ink solvent 100 can fly continuously in this manner without being cut is that a pressure P due to the surface tension which acts to cut the ink solvent 100 is canceled out by the electrostatic repulsion force between the charged pigment particles 1*a* contained inside the ink solvent 100. The pressure P due to the surface tension v of the ink solvent 100 is expressed by the following mathematical formula (10);

$$P = \frac{v}{r_1} \tag{10}$$

wherein, $r_1$ is a radius of edge face of the ink solvent 100.

The followings are summary of the above explained principle of ink flying.

Electric field regions which permit liquid ink drops to fly from the top end of the discharge electrode 11*a* are roughly classified into the following three regions as illustrated in FIG. 24.

One is a cohesion region 220 from the first threshold value electric field Ec to the second threshold value electric field E'c, and in this region only the spherical shaped pigment aggregate 1 as illustrated in FIG. 11 flies out as the liquid ink drops. Further, although the ink discharge cycle is comparatively long, no extra charged pigment particles fly out from the top end of the discharge electrode 11*a*, therefore, fine pixels can be recorded on a recording medium, and thus such cohesion region 220 is suitable for a highly accurate recording.

The remaining two belong to an electric field region more than the second threshold value electric field E'c. One of the two regions is the condensation region 222 in which only the semispherical shaped or the thick shell shaped pigment aggregates 190 as illustrated in FIG. 20 fly out, and the other region is the cohesion and condensation coexistence region 221 transiting from the cohesion region 220 to the condensation region 222. In the condensation region 222 the ink solvent containing the charged pigment particles also fly together with the semispherical shaped or the thick shell shaped pigment aggregates 190 from the top end of the discharge electrode 11*a,* therefore, large pixels can be recorded with high speed in comparison with the operation in the cohesion region 220. Such condensation region 222 is suitable for a solid print recording.

Accordingly, in the present embodiment by making use of the cohesion region 220 and the condensation region 222 among the three regions as shown above, two kinds of recording modes (a cohesion mode making use of the cohesion region 220 and a condensation region making use of the condensation region 222) are introduced in the printer device. Hereinbelow, the overall structure of the printer device will be explained. However, herein for the sake of explanation convenience a line type monochromatic printer is exemplified.

Figure 1:
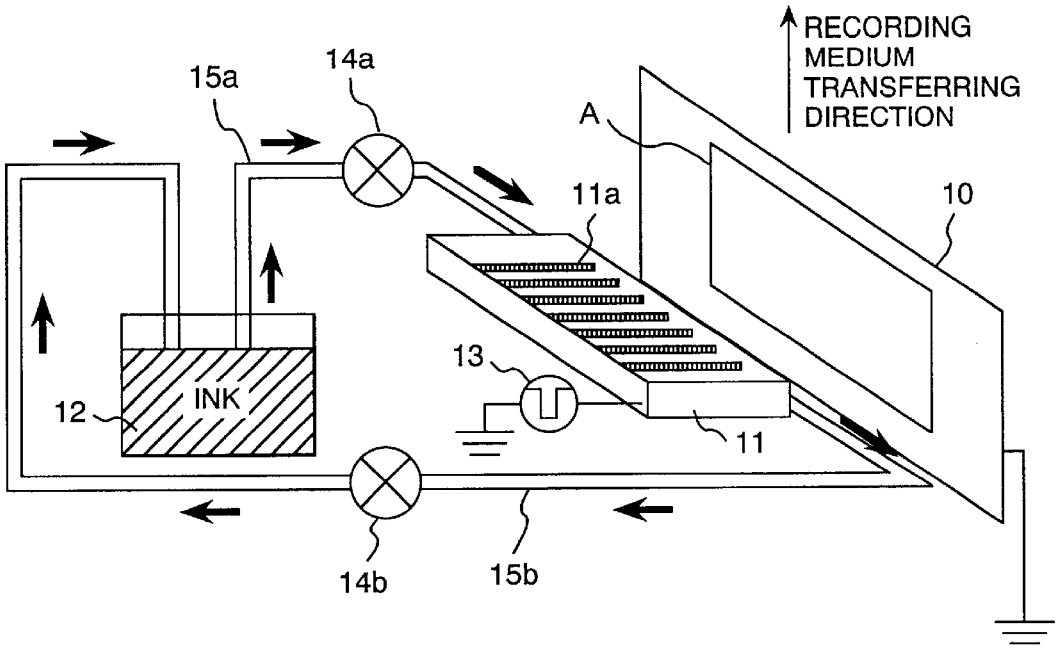
FIG. 1 a schematic structure of a printer device representing one embodiment according to the present invention.

As illustrated in FIG. 1, inside a housing of the present printer device such as the following members are accommodated; a line type recording head 11 made of a material having a low dielectric constant (such as acrylic resin and ceramics), an opposing electrode 10 made of a metal or a material having a high dielectric constant which is disposed so as to oppose to an ink discharge port of the recording head 10, an ink tank 12 in which ink prepared by dispersing charged pigment particles in a nonconductive ink medium, an ink circulating system for circulating the ink between the ink tank 12 and the recording head 11, a pulse voltage generating device 13 which applies a pulse voltage for pulling out ink drops for forming a unit pixel for image recording at respective discharge electrodes 11*a,* a driving circuit (not shown) which controls the pulse voltage generating device 13 in response to image data, a recording medium transferring mechanism (not shown) which causes to pass a recording medium A in a gap formed between the recording head 11 and the opposing electrode 10 and a controller (not shown) which controls the entire device.

Now, the ink circulating system is constituted by two pipes 15*a* and 15*b* connecting between the recording head 11 and the ink tank 12 and two pumps 14*a* and 14*b* driven through control of the controller, and is divided into an ink feeding system for feeding ink to the recording head 11 and an ink collecting system for collecting ink from the recording head 11. In the ink feeding system, the ink is sucked up from the ink tank 12 by the pump 14*a* and is pressure-transferred via the pipe 15*a* to an ink feeding unit (20*a* in FIGS. 2 and 3) in the recording head 11. On the other hand, in the ink collecting system the ink is sucked from an ink collecting unit (20*b* in FIGS. 2 and 3) in the recording head 11 by the pump 14*b* and is forcedly collected via the pipe 15*b* to the ink tank 12.

Figure 2:
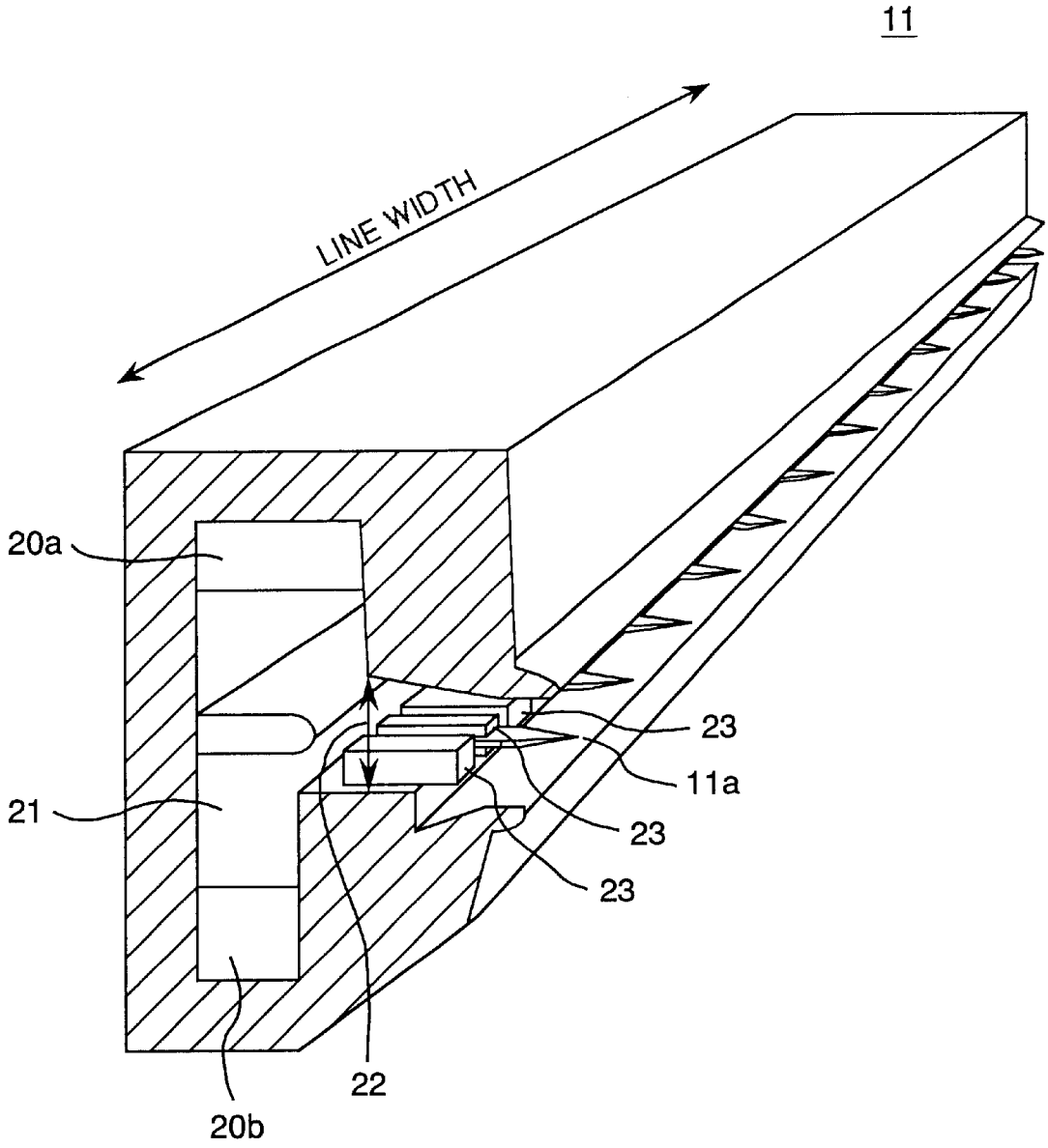
FIG. 2 is a perspective view of a recording head relating to the one embodiment according to the present invention.
Figure 3:
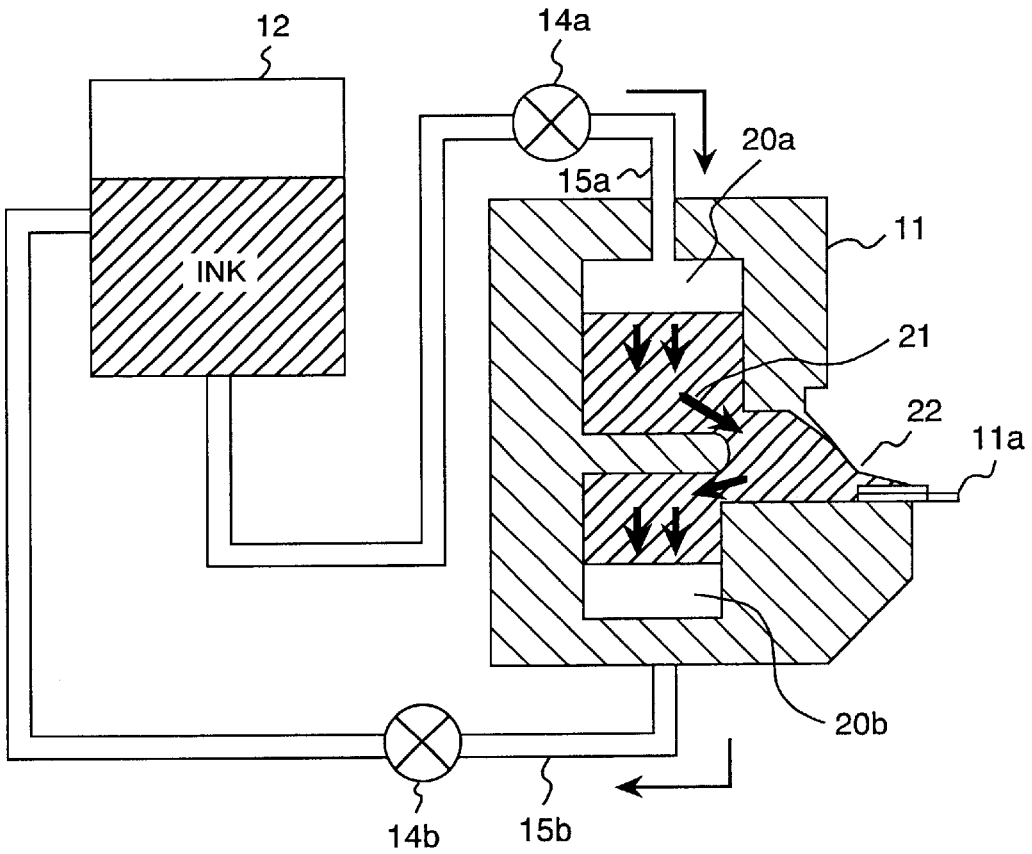
FIG. 3 is a cross sectional view of the recording head and an ink circulating system relating to the one embodiment according to the present invention.
Figure 4:
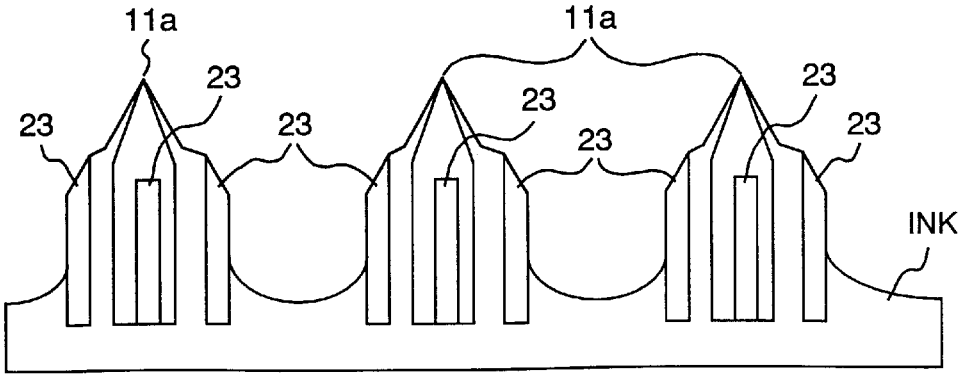
FIG. 4 is a partial view of top end portions of discharge electrodes in the recording head relating to the one embodiment according to the present invention.

As illustrated in FIGS. 2 and 3, the recording head 11 is provided with the ink feeding unit 20*a* in which the ink fed from the pipe 15*a* in the ink feeding system is spread into a line width, an ink flow passage 21 which guides the ink from the ink feeding unit 20*a* in a crest shape, the ink collecting unit 20*b* which connects the ink flow passage 21 with the pipe 15*b* in the ink collecting system, a slit shaped ink discharge port 22 which opens a top portion of the ink flow passage 21 toward the opposing electrode 11 with a proper width (of about 0.2 mm), a plurality of discharge electrodes 11*a* arranged inside the ink discharge port 22 with a predetermined pitch (of about 0.2 mm) and partition walls 23 made of a material having a low dielectric constant (for example, ceramics) which are respectively disposed both sides and upper side of the respective discharge electrodes 11*a*. The respective discharge electrodes 11*a* are formed of a metal such as copper and nickel and on which surfaces a film of a material having a low dielectric constant and having a good wettability (for example, polyimide film) is formed which serves to prevent the pigment from sticking thereon. Further, the top ends of the respective discharge electrode 11*a* are shaped into a triangular pyramid and the respective triangular pyramids are projected from the ink discharge port 22 toward the opposing electrode 10 by a proper length (70 pm–80 pm).

Figure 5A:
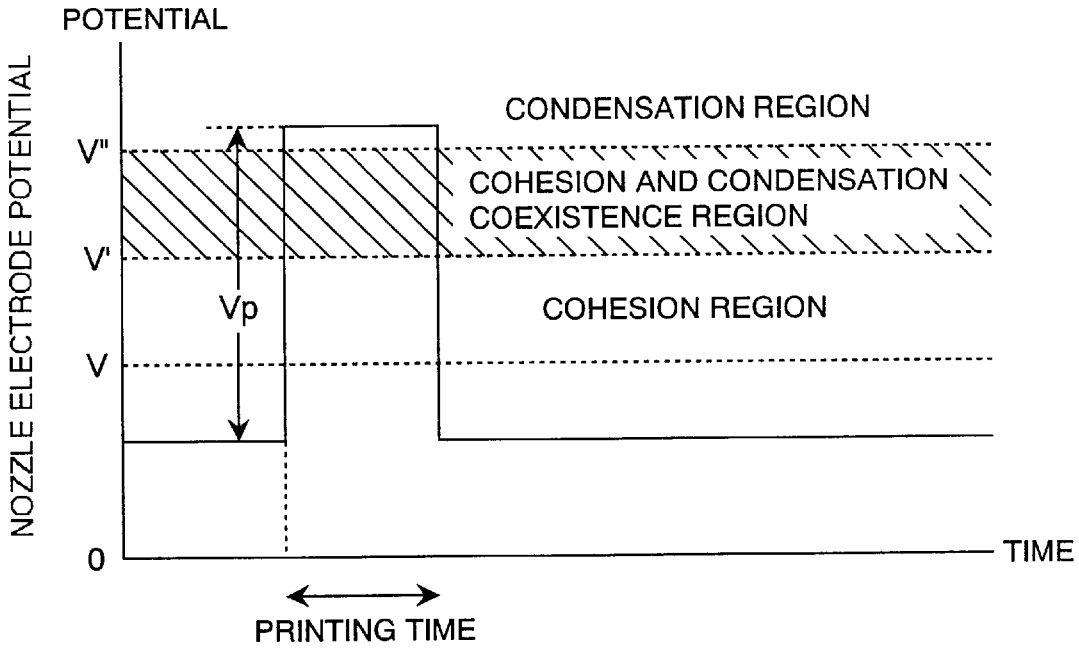
FIGS. 5(*a*) and (*b*) are diagrams of voltage wave form applied to the discharge electrodes in the recording head relating to the one embodiment according to the present invention.
Figure 5B:
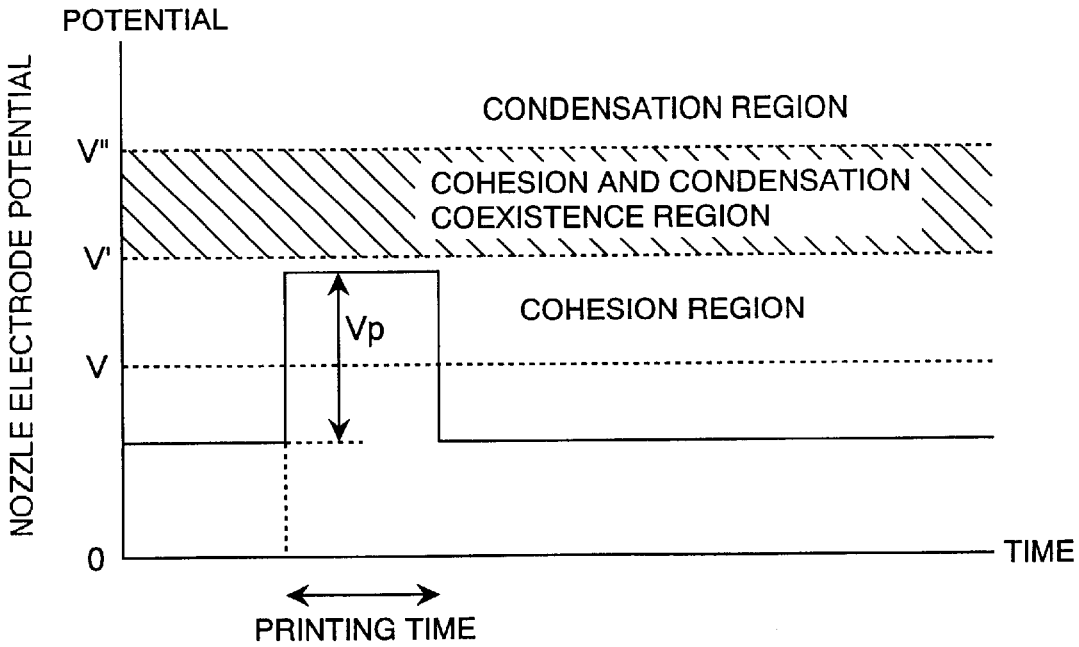

When the driving circuit provides either of two kinds of control signals (first control signal or second control signal) to the pulse voltage generating circuit 13 in response to the control of the controller for the time corresponding to the gradation data contained in the image data, the pulse voltage generating circuit 13 applies to the discharge electrodes 11*a* a high voltage signal formed by superposing a pulse top pulse Vp depending on the kind of the control signal on a bias voltage Vb, namely, a high voltage signal formed by superposing a pulse top pulse Vp which exceeds the minimum potential V" for generating the electric field for the condensation region as illustrated in FIG. 5(*a*) or another high voltage signal formed by superposing a pulse top pulse Vp which exceeds the minimum voltage V for generating the electric field for the cohesion region as illustrated in FIG. 5(*b*). Further, the pulse voltage generating circuit 13 is constituted by such as two pulse power sources which generate different potentials each other, a switching circuit which switches the two different potentials depending on the control signal from the driving circuit and a biasing power source which applies the biasing voltage Vb to the switching circuit, and when the first control signal is inputted from the driving circuit to the pulse voltage generating circuit 13, the switching circuit superposes the potential from the first pulse power source over the biasing voltage Vb during the existence of the input signal and outputs the same, and when the second control signal is inputted from the driving circuit to the pulse voltage generating circuit 13, the switching circuit superposes the potential from the second pulse power source over the biasing voltage Vd during the existence of the input signal and outputs the same.

Now, when image data are transferred, the controller drives the two pumps 14*a* and 14*b* in the ink circulating system. Thereby, ink is pressure-transferred from the ink feeding unit 20*a* as well as the ink collecting unit 20*b* is placed in a negative pressure, and the ink flowing through the ink flow passage creeps up along the gaps defined by the respective partition walls 23 through capillary phenomenon to spread up to the top ends of the respective discharge electrodes 11*a* while wetting the same. At this moment a negative pressure is applied on the liquid ink surface near the top ends of the respective discharge electrodes 11*a,* and an ink meniscus is respectively formed at the top ends of the respective discharge electrodes 11*a*. Further, the controller transfers the recording medium A in a predetermined direction through control of the recording medium transferring mechanism as well as applies either of the two kinds of high voltage signals to the respective discharge electrodes 11*a* through control of the driving circuit. Thereby, an image recording is performed either by the cohesion mode or by the condensation mode.

Figure 6A:
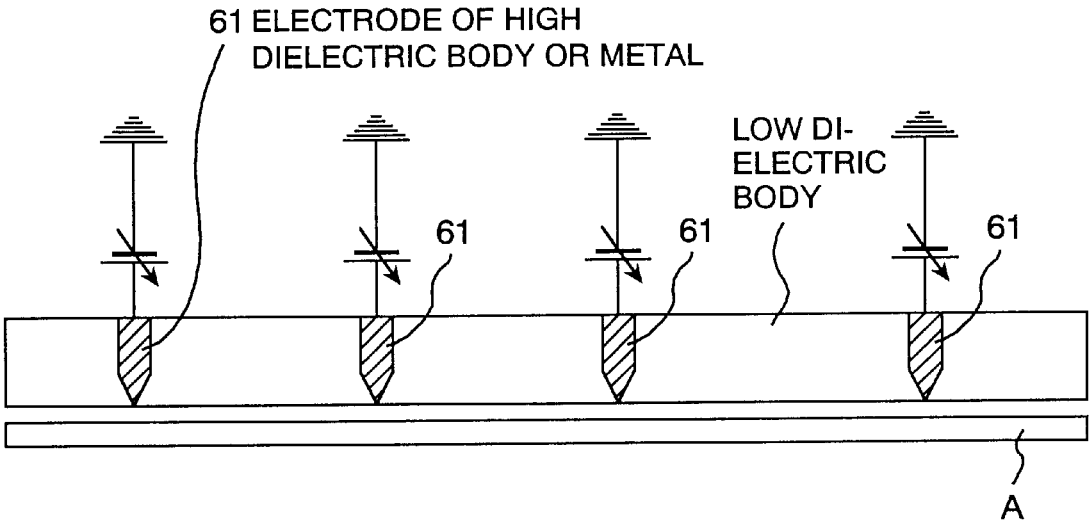
FIG. 6(*a*) is a schematic structure of an opposing electrode relating to the one embodiment according to the present invention.
Figure 6B:
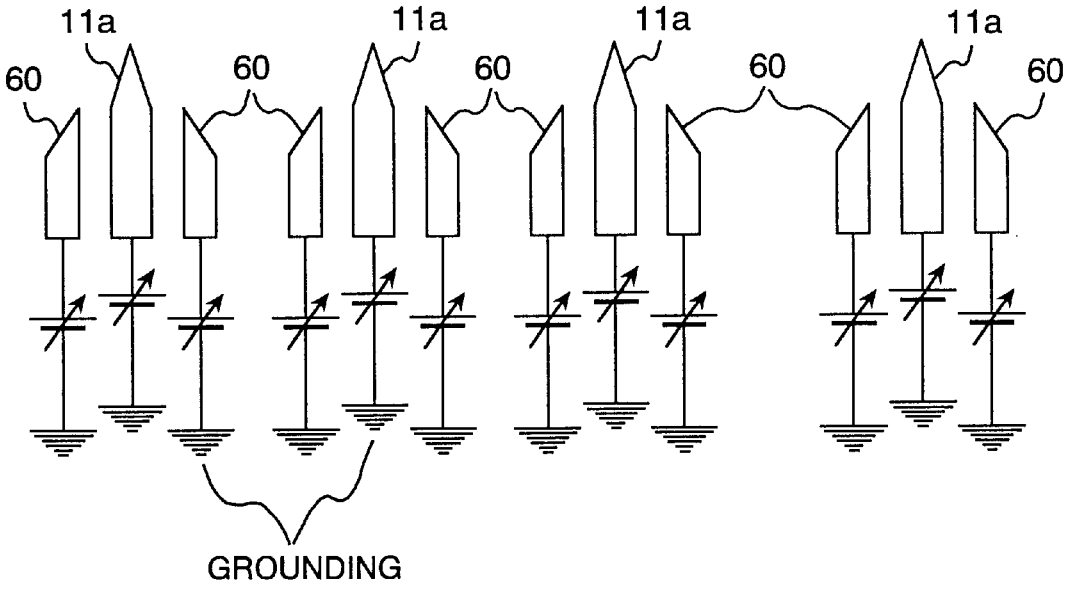

Further, the structure as shown in FIG. 1 represents the minimum indispensable elements as a printer device which makes use of the ink flying principle according to the present embodiment. Therefore, other constituting elements can be added thereto. For example, if being provided respective auxiliary electrodes 60 at both sides of the discharge electrodes 11*a* as illustrated in FIG. 6(*b*) and a high or low potential which cancels out an electrical interaction between the adjacent respective discharge electrodes 11*a* is applied to the auxiliary electrodes 60, possible inconveniences can be avoided (for example, liquid ink drops fly out from the top ends of undesired discharge electrodes) which can be caused such as when high voltage signals are applied at the same time on mutually adjacent discharge electrodes 11*a* and when the pulse top potential is raised in order to increase the pixel density. These auxiliary electrodes 60 can be disposed as an intermediate layer while forming the partition walls 23 provided at both sides of the respective discharge electrodes 11*a* as laminates.

Figure 7A:
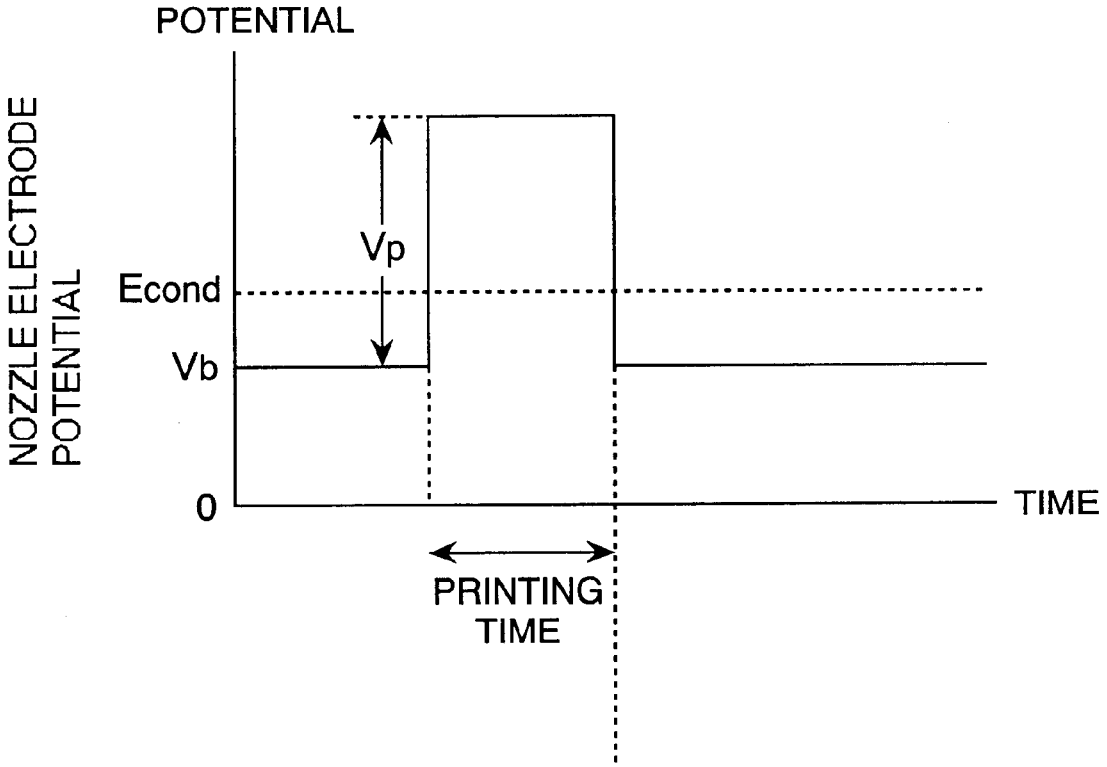
FIG. 7(*a*) is a diagram of voltage wave form applied to the discharge electrodes in the recording head relating to the one embodiment according to the present invention.
Figure 7B:
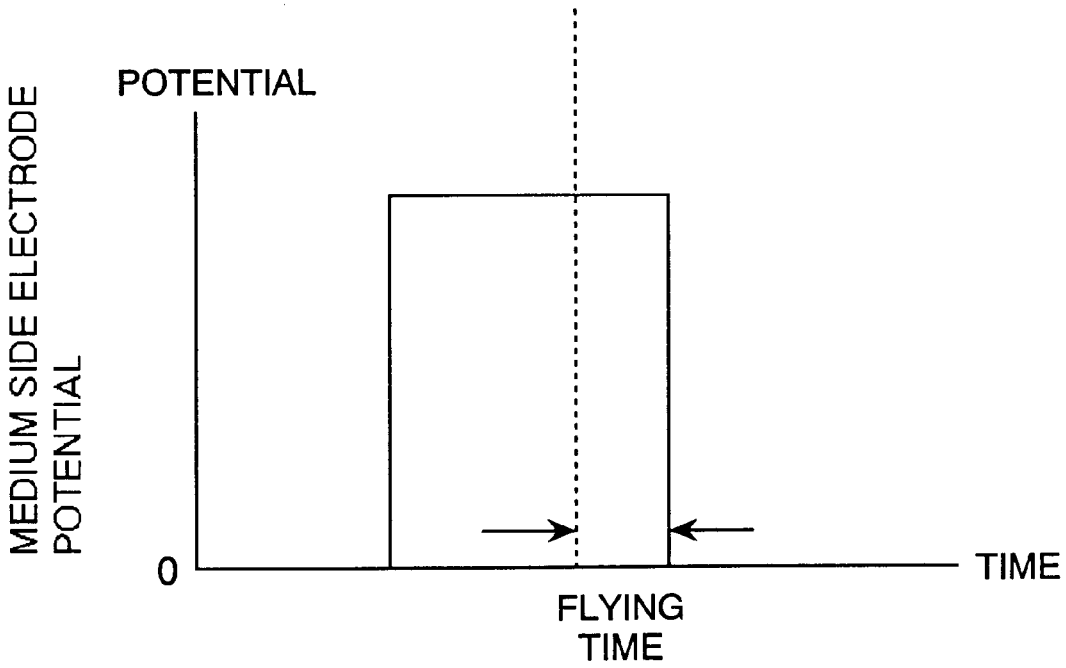

Further, in FIG. 1 the single piece of the opposing electrode 10 is simply grounded, however, as illustrated in FIG. 6(*a*) if the respective opposing electrodes 61 made of a metal or a material having a high dielectric constant are provided for every discharge electrode 11*a* and the potentials of the opposing electrode 61 and of the corresponding discharge electrode 11*a* are controlled in synchronism, the flying behavior of the liquid ink drops can be improved. Further, as illustrated in FIG. 7 if the pulse width of the pulse voltage to be added to the respective opposing electrodes 61 is determined while taking into account of the necessary time of the flying liquid ink drops to reach the recording medium, a possible scattering of the liquid ink drops is prevented.

Still further, in the present embodiment two kinds of pulses having mutually different pulse top potentials are superposed over the biasing voltage, however, if the pulse top potential is controlled further finely, a recording of further higher gradation can be realized. Still further, if a pulse width modulation is performed, a recording of still further higher gradation can, of course, be realized.

Lastly, an ink suitable for use with the printer device according to the present embodiment will be explained.

Since the first threshold value electric field Ec as has been referred to above is a minimum electric field necessary for growing the spherical shaped pigment aggregate 1 and the semispherical shaped pigment aggregate 190 up to the escape radius near the liquid ink surface, therefore, if such amount of electric field is simply applied to the top end of the discharge electrode 11*a,* it takes long time to grow the pigment aggregate 1 up to the escape radius as illustrated in FIG. 18, and the ink discharge cycle from the top end of the discharge electrodes 11*a* exceeds over 10 sec., thereby, a sufficient recording speed can not be obtained. In order to obtain a sufficient recording speed, it is necessary to increase the flying out frequency of the pigment aggregates 1 from the top end of the discharge electrode 11*a* as illustrated in FIG. 19 by intensifying the electric field at the to end of the discharge electrode 11*a* more than the first threshold value electric field Ec (about 1.2~1.5 times of the first threshold value electric field Ec) and by increasing the aggregation force and the aggregation speed of the charged pigment particles 1*a*. However, in order to intensify the electric field at the top end of the discharge electrode 11*a,* it is necessary to introduce expensive power semiconductor elements, therefore, the upper level of the electric field at the top end of the discharge electrode 11*a* is limited by its cost consideration. In order to obtain a sufficient recording speed within such limited electric field range it is preferable to suppress the first threshold value electric field Ec as much as possible.

When studying the mathematical formula (9), it is understood that the first threshold value electric field Ec is proportional to $\sqrt[3]{v}$, cubic root of surface tension v of the ink solvent, in other words, if the surface tension v of the ink solvent is suppressed, the first threshold value electric field Ec can be suppressed accordingly. Based on this understanding, it is deduced that if a surface active agent which reduces the surface tension v of the ink solvent is added, the first threshold value electric field Ec is effectively suppressed. For example, a surface tension of an organic solvent which is generally understood suitable for ink medium in view of its material property can be suppressed down to 13~14 dyn/cm through addition of fluorine series surface active agents. Further, the surface tension of water (according to the present embodiment pure water so as to ensure non-conductivity thereof) is 72.5 dyn/cm at 25° C. of which use is desired in view of environment consideration, however, if a non-ion surface active agent is added thereto, the surface tension thereof is suppressed down to 20 dyn/cm. Still further, the addition of a surface active agent is also useful for ensuring a proper viscosity of the ink.

Figure 25:
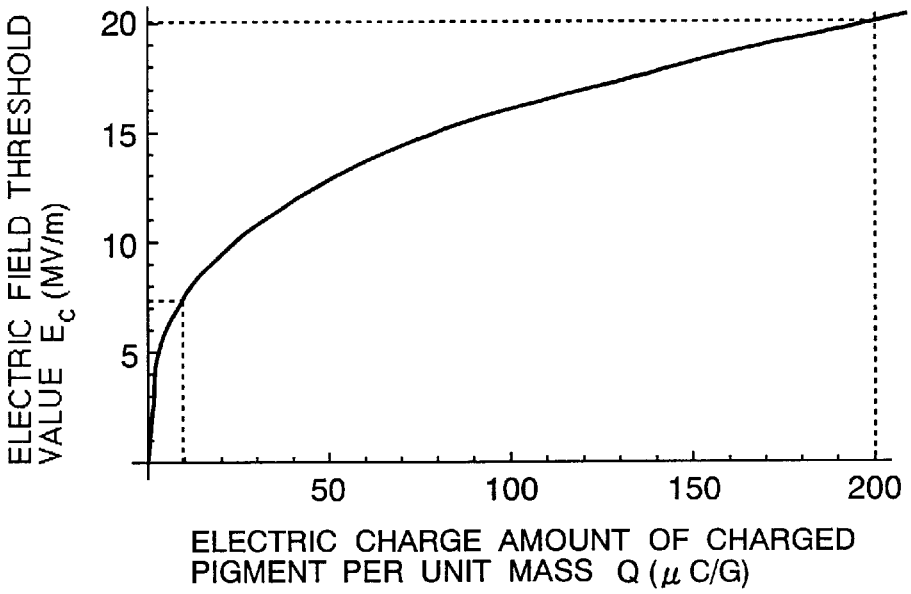
FIG. 25 is a graph showing a relationship between electric charge of charged pigment particles per unit mass and first threshold value electric field.

When further studying the mathematical formula (9), it is understood that the first threshold value electric field Ec is proportional to $\sqrt[3]{Q}$, cubic root of the electric charge amount Q of the charged pigment particles 1*a* per unit mass, in other words, if the electric charge amount Q of the charged pigment particles 1*a* per unit mass is suppressed, the first threshold value electric field Ec can be suppressed. For example, when substituting the above referred to typical data for the parameters v, $\alpha$ and $\rho$ in the mathematical formula (9) and a relationship between the obtained Q and Ec are graphically illustrated as in FIG. 25, the above fact can be visually recognized. In view of the fact that in order to obtain a sufficient recording speed an electric field more than 1.2~1.5 times of the first threshold value electric field Ec has to be applied at the top end of the discharge electrode 11*a,* a desirable first threshold value electric field Ec which unnecessitates the use of power semiconductor elements under the condition when the top end of the discharge electrode is shaped in an optimum shape (a triangular pyramid shape) is less than about 20 MV/m, namely the electric charge amount Q of the charged pigment particles 1*a* in ink per unit mass is less than 200 $\mu$C/g. If the both values exceed the above limits, a potential of at least 6 kV~12 kV has to apply to the discharge electrode 11*a* which necessities the use of power semiconductor elements. Accordingly, in order to obtain a sufficient recording speed with a low cost, it is necessary to reduce the electric charge amount Q of the charged pigment particles 1*a* in ink per unit mass less than about 200 $\mu$C/g. However, if the electric charge amount of the charged pigment particles 1*a* per unit mass is oversuppressed, the following inconveniences are caused because of the excess reduction of the mutual electrostatic repulsion force between the charged pigment particles 1*a:* (1) the charged pigment particles 1*a* aggregate such as in the ink tank and the ink flow passages, and an ink having a predetermined density hardly circulates; (2) the ink clogs such as in the ink passage, and ink discharge stability reduces; (3) response speed of the charged pigment particles 1*a* reduces, and the recording speed reduces. In particular, if the electric charge amount of the charged pigment particles 1*a* per unit mass reduces less than 10 $\mu$C/g, the above inconveniences are more likely caused. Accordingly, it is necessary to determine a proper electric charge amount Q of the charged pigment aggregates 1*a* dispersed in ink per unit mass in a range in which the sufficient recording speed is ensured with a low cost and the occurrence of the above referred to inconveniences (1), (2) and (3) are avoided, namely, in a range more than 10 $\mu$C/g and less than 200 $\mu$C/g.

Further, if the radius r of the charged pigment particles 1*a* in ink is reduced, the electric charge amount of the charged pigment particles 1*a* per unit mass reduces and the mutual electrostatic repulsion force of the charged pigment particles 1*a* also reduces, therefore, the above inconveniences (1), (2)

and (3) can be caused like the above instance when the electric charge amount Q of the charged pigment particles 1*a* per unit mass is excessively reduced. In particular, when the radius r of the charged pigment particles 1*a* reduces less than 0.1 μm, the above inconveniences is likely caused with a high possibility. Contrary, if the radius r of the charged pigment particles 1*a* becomes excessively large, the flow resistance effected by the ink solvent becomes large and the moving speed of the charged pigment particles 1*a* in the ink solvent reduces which reduces the recording speed. In particular, if the radius r of the charged pigment particles 1*a* exceeds 5 μm, the recording speed reduces significantly. Accordingly, a proper radius r of the charged pigment particles 1*a* dispersed in the ink has to be determined in a range which prevents reduction in recording speed and avoids the occurrence of the above inconveniences (1), (2) and (3), namely in a range more than 0.1 μm and less than 5 μm.

Further, in order to effectively prevent the above inconveniences (1), (2) and (3) caused due to small electrostatic repulsion force between the charged pigment particles 1*a* it is preferable in addition to the above charged pigment particles 1*a* which contribute the formation of pixels to disperse one or two kinds of charged pigment particles in less than 50 vol % which prevent deposition and aggregation of the charged pigment particles 1*a* such as in the ink flow passages, for example, charged pigment particles having a larger electric charge amount than that of the charged pigment particles 1*a* or charged pigment particles having a larger particle diameter than that of the charged pigment particles 1*a*.

Figure 26:
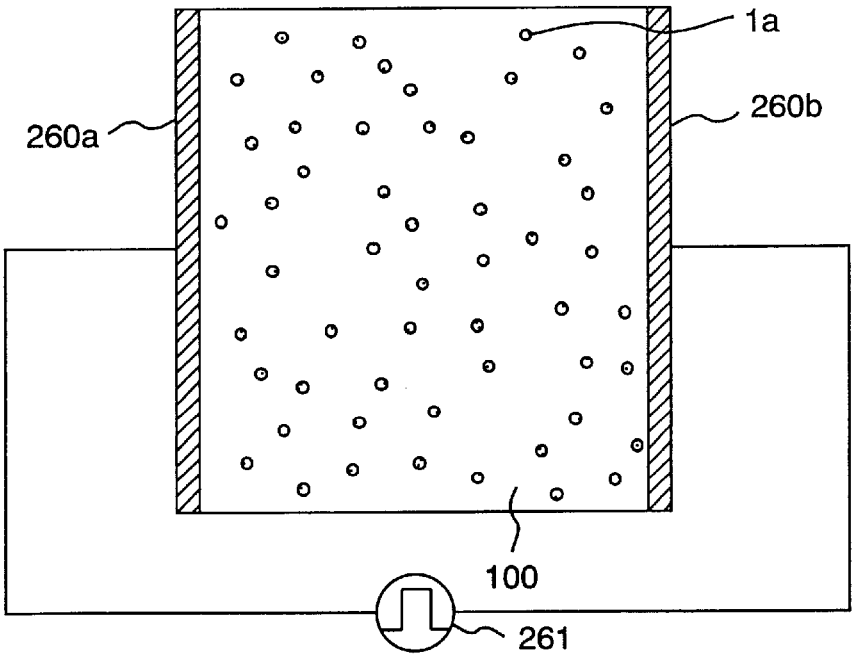
FIG. 26 is a model diagram for explaining motion of the charged pigment particles in an ink stream.
Figure 27:
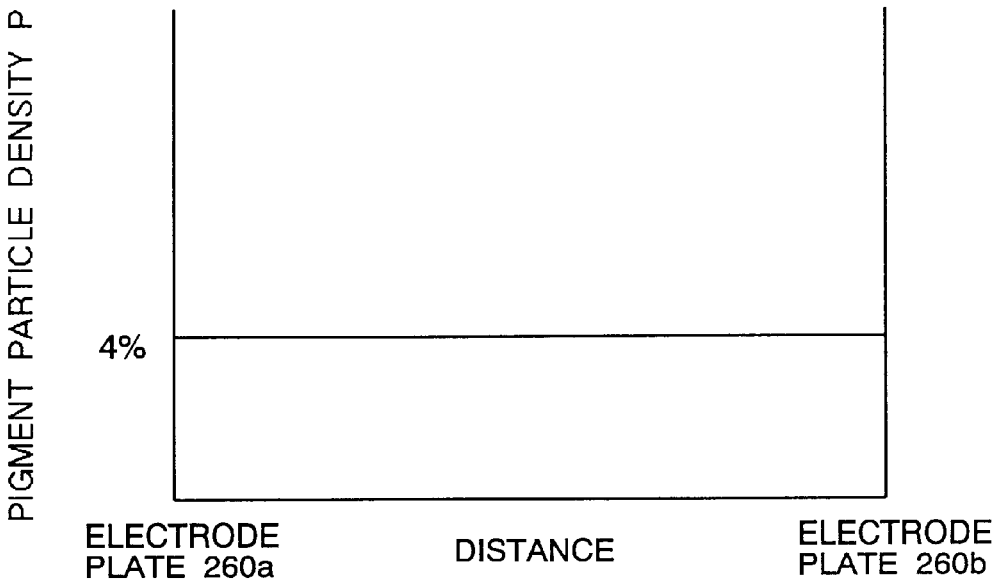
FIG. 27 is another model diagram for explaining motion of the charged pigment particles in an ink stream.
Figure 28:
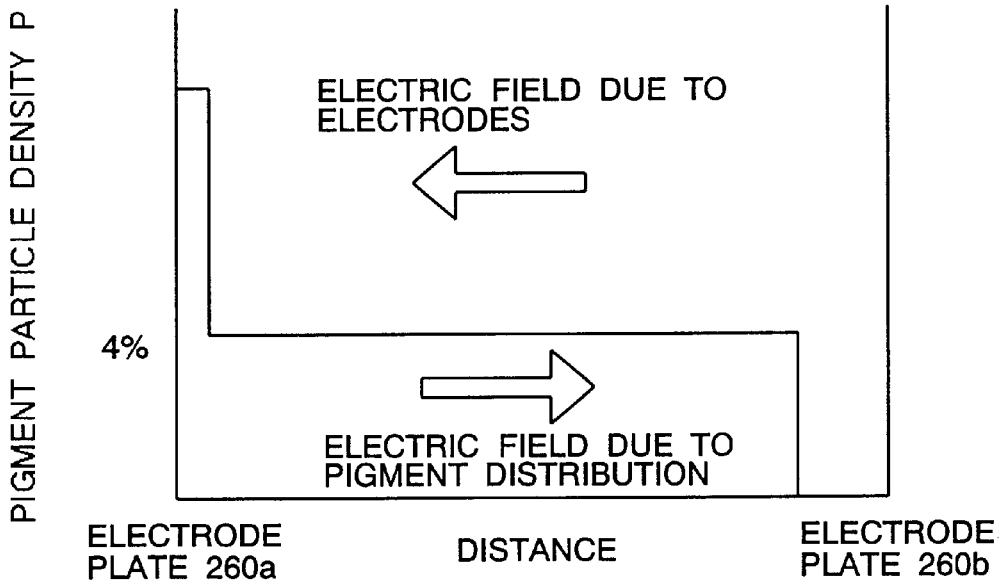
FIG. 28 is still another model diagram for explaining motion of the charged pigment particles in an ink stream.

Still further, it is preferable that the rate of such charged pigment particles in the ink is about 2 vol %~10 vol %. The reason why the containing rate of such charged pigment particles in the ink is determined less than 10 vol % is that if the rate of the charged pigment particles in the ink exceeds the above value, the viscosity of the ink excessively increases and the response speed thereof delays. On the other hand, the reasons why the containing rate of such charged pigment particles in the ink is determined more than about 2 vol % is that if the rate of the charged pigment particles in the ink is selected more than about 2 vol %, a response frequency of about 1~10 kHz can be realized as shown below. Under a condition that an ink in which the charged pigment particles 1*a* are dispersed in non-conductive ink solvent in an amount of less than 2 vol % is confined between two electrode plates 260*a* and 260*b* as illustrated in FIG. 26, when an ON and OFF of a power source 216 of 1 kV is repeated, the respective charged pigment particles 1*a* electro-phoretically move in the static ink solvent 100 at most 0.1~2 mm/sec. With such extent of motion speed of the charged pigment particles 1*a* the response frequency of about 1~10 kHz can not be realized. However, the containing rate of the charged pigment particles 1*a* in the ink is increased more than about 2 vol %, a plurality of vortexes are generated in the ink solvent 100 due to pigment density difference caused in the ink and the charged pigment particles 1*a* move rapidly along with the stream of these vortexes which permits to realize the response frequency of about 1~10 kHz. For example, in case of an ink in which charged polymer pigment particles having electric charge amount of 40 μC/g per unit mass, density of 1.4 g/cm$^3$ and radius of 0.25 μm are disposed in an organic solvent in an amount of 4 vol %, the initial distribution of the charged pigment particles 1*a* in the ink solvent is uniform as illustrated in FIG. 27, however, where a voltage of 1 kV is applied, the distribution varies as illustrated in FIG. 28 so as to cancel out the potential difference. During the course of this variation the charged pigment particles move as follows; the distribution of the charged pigment particles in the ink solvent scatters to some extent, to which if an intense electric field is applied, the vortexes are generated in the ink solvent due to an external force difference between large pigment density and small pigment density.

Although it is preferable to prepare the ink used for the printer device according to the present embodiment to satisfy all of the above mentioned conditions, however, it will be acceptable if the same is prepared to satisfy at least one condition of the above.

Further, in the FIG. 2, if the top ends of the respective partition walls 23 are configurated in a sharp triangular shape as well as if the gap between the partition walls 23 disposed both sides of the discharge electrode 11*a* is gradually restricted toward the top end thereof, the liquid ink drops can be concentrated at the top end of the discharge electrodes 11*a*. Thus a 20 channel recording head is obtained with the above discharge electrode structure. Further, another 20 channel recording head is obtained with the partition walls 23 having a flat top end. Actually, the recording head is formed to have 100~several thousands channels depending on the width of the recording medium. In the present embodiment, the width of the outlet slit formed by the partition walls 23 can be varied in a range of 5 μm~30 μm and the entire width of the partition walls 23 can be varied in a range 30 μm~100 μm. The top ends of the respective discharge electrodes 11*a* are a triangle shape and the top end angle thereof is about 60°. Further, the respective discharge electrodes 11*a* are thin films (film thickness of about 20 μm) made of such as Cu, Ag and Au, the partition walls 23 are polyimide and the base plate is a glass plate.

Figure 29:
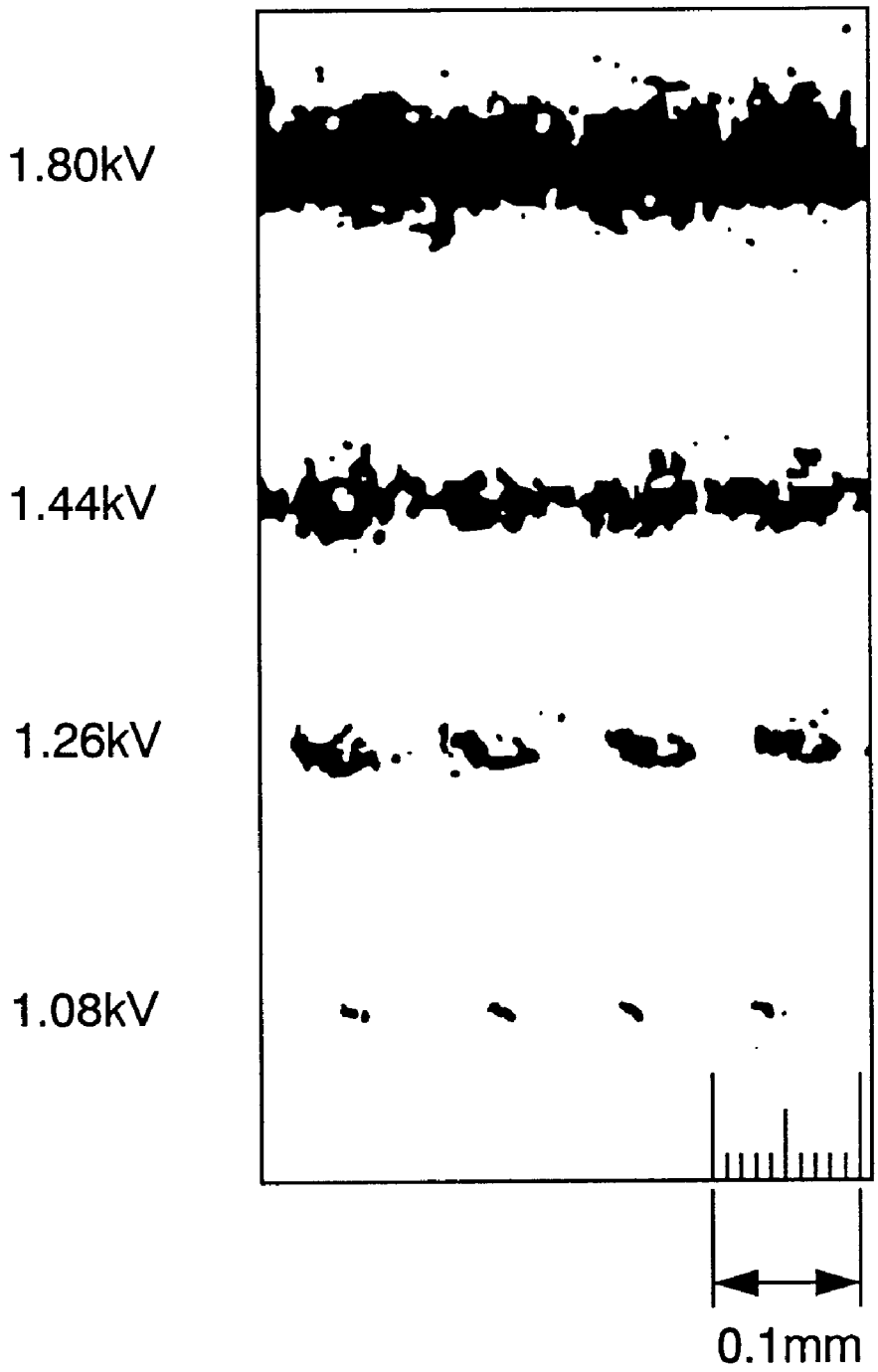
FIG. 29 is an enlarged view of print dots printed with pulse width of 1.0 msec.
Figure 30:
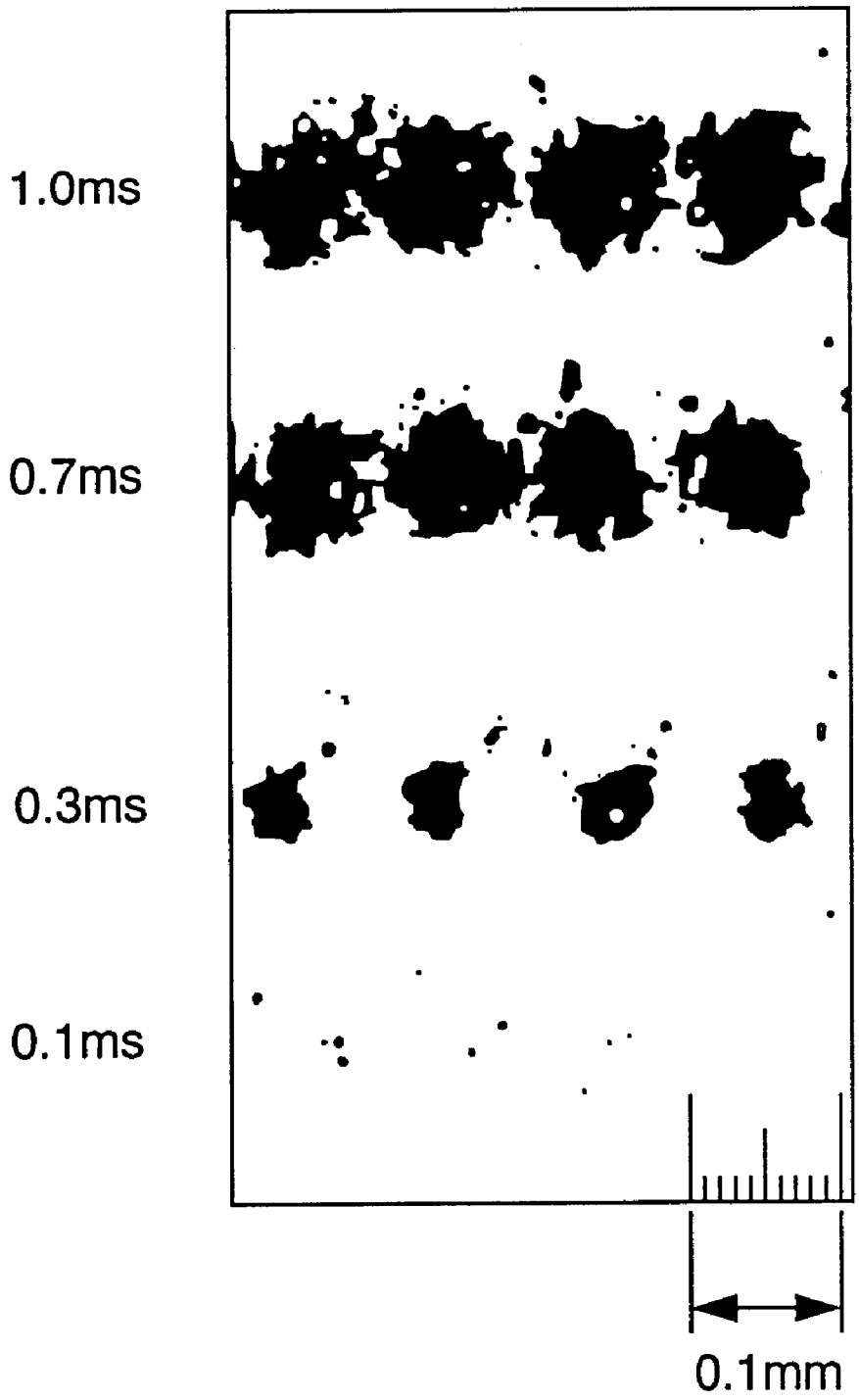
FIG. 30 is an enlarged view of print dots printed with pulse voltage of 1.8V.

FIGS. 29 and 30 are enlarged view of black print dots printed by the printer device using the partition walls 23 having the triangle shaped top end portions. FIG. 29 is an enlarged view of print dots when the pulse width is fixed at 1,0 msec. and FIG. 30 is an enlarged view of print dots when the pulse voltage is fixed at 1.8 kV, wherein the characteristics of the ink used and others are that the electric charge amount: 40 μC/g, the diameter of the pigment particle: 0.5 μm, solvent: isoper G, the biasing voltage: 1.0 msec. and gap to the opposing electrode: 1.0 mm.

As illustrated in FIGS. 29 and 30, when varying the pulse voltage and the pulse width, the print dot diameter can be varied either to large one or to small one. Further, a continuous solid print can be obtained. In particular, according to the present embodiment almost all of the print dots can be reduced to 3 μm~5 μm, thereby, an extremely clear recording image can be obtained. Thus, the respective print dots are formed by an aggregation of fine particles less than 10 μm, thereby a further clear printing can be performed.

According to the present invention, a printer device can be realized which shows a high ink discharge stability and permits a highly accurate, fine and high gradation recording with a high speed.

What is claimed is:

1. A printer device comprising:

a plurality of discharge electrodes provided in a slit to which ink containing charged pigment particles is supplied;

a plurality of opposing electrodes opposing said plurality of discharge electrodes;

pulse electric field applying means for forming a pulse electric field between said plurality of discharge electrodes and said plurality of opposing electrodes; and auxiliary electrodes provided at both sides of respective ones of said plurality of discharge electrodes, one of a high and low potential being applied to said auxiliary electrodes so as to cancel out an electric interaction between respective ones of said plurality of discharge electrodes.

2. A printer device according to claim 1, wherein a respective one of said plurality of opposing electrodes is provided so as to oppose a respective one of said plurality of discharge electrodes.

3. A printer device according to claim 1, wherein a top end of respective ones of said plurality of discharge electrodes is restricted so as to concentrate the electric field.

4. A printer device according to claim 1, wherein a respective one of said plurality of opposing electrodes is provided so as to oppose a respective one of said plurality of discharge electrodes, and wherein a top end of respective ones of said plurality of discharge electrodes is restricted so as to concentrate the electric field.

5. A printer device according to claim 1, wherein said pulse electric field applying means comprises a controller which varies a pulse voltage and a pulse width so as to vary a diameter of a print dot.

6. A printer according to claim 1, wherein a respective one of said plurality of opposing electrodes is provided so as to oppose a respective one of said plurality of discharge electrodes, and wherein said pulse electric field applying means comprises a controller which varies a pulse voltage and a pulse width to vary a diameter of a print dot.

7. A printer device according to claim 1, further comprising at least one partition member for guiding ink drops toward a top end of respective ones of said plurality of discharge electrodes.

8. A printer device according to claim 1, further comprising at least one partition member for guiding ink drops toward a top end of respective ones of said plurality of discharge electrodes, and wherein a respective one of said plurality of opposing electrodes is provided so as to oppose a respective one of said plurality of discharge electrodes.

* * * * *